US012234412B2

(12) United States Patent
Cartolano et al.

(10) Patent No.: US 12,234,412 B2
(45) Date of Patent: Feb. 25, 2025

(54) OLEFIN AND AROMATICS PRODUCTION BY THE CATALYTIC PYROLYSIS OF POLYMERS

(71) Applicant: Anellotech, Inc., Pearl River, NY (US)

(72) Inventors: Anthony Cartolano, Pearl River, NY (US); Yu-Ting Cheng, Pearl River, NY (US); Sandeep Goud, Pearl River, NY (US); Samuel A. Sefa, Pearl River, NY (US); Charles Sorensen, Pearl River, NY (US)

(73) Assignee: Anellotech, Inc., Pearl River, NY (US)

( * ) Notice: Subject to any disclaimer, the term of this patent is extended or adjusted under 35 U.S.C. 154(b) by 636 days.

(21) Appl. No.: 16/783,982

(22) Filed: Feb. 6, 2020

(65) Prior Publication Data

US 2020/0362248 A1 Nov. 19, 2020

Related U.S. Application Data

(60) Provisional application No. 62/847,933, filed on May 14, 2019.

(51) Int. Cl.

| | |
|---|---|
| ***C10G 1/10*** | (2006.01) |
| ***C10B 49/22*** | (2006.01) |
| ***C10B 53/07*** | (2006.01) |
| ***C10B 57/06*** | (2006.01) |

(52) U.S. Cl.

CPC ..... *C10G 1/10* (2013.01); *C10B 49/22* (2013.01); *C10B 53/07* (2013.01); *C10B 57/06* (2013.01); *C10G 2300/1003* (2013.01); *C10G 2400/20* (2013.01); *C10G 2400/22* (2013.01)

(58) Field of Classification Search

CPC ..... C10G 1/10; C10G 2300/1003; C10G 2400/20; C10G 2400/22; C10G 2300/1011; C10G 2300/4081; C10G 2300/708; C10G 2400/30; C10G 11/18; C10G 11/182; C10B 49/22; C10B 53/07; C10B 57/06; Y02P 20/145

See application file for complete search history.

(56) References Cited

U.S. PATENT DOCUMENTS

| | | | |
|---|---|---|---|
| 4,029,716 | A | 6/1977 | Kaeding |
| 4,851,601 | A | 7/1989 | Fukuda et al. |
| 5,079,385 | A | 1/1992 | Wu |
| 5,158,983 | A | 10/1992 | Stapp |

(Continued)

FOREIGN PATENT DOCUMENTS

| | | | |
|---|---|---|---|
| CN | 106520174 | A | 3/2017 |
| JP | 2000024622 | A | 1/2000 |

OTHER PUBLICATIONS

Li et al. "Improving the aromatic production in catalytic fast pyrolysis of cellulose by co-feeding low-density polyethylene", Applied Catalysis A: General 455 (2013) 114-121. (Year: 2013).*

(Continued)

*Primary Examiner* — Ali Z Fadhel
(74) *Attorney, Agent, or Firm* — Frank Rosenberg

(57) ABSTRACT

The invention comprises methods of catalytically pyrolyzing plastics. Since it has been discovered that plastics provide insufficient coke to provide adequate heat during catalyst regeneration, heat-forming additives can be introduced into the methods. Systems and compositions useful in the catalytic pyrolysis of plastics are also described.

15 Claims, 7 Drawing Sheets

(56) References Cited

U.S. PATENT DOCUMENTS

| | | | |
|---|---|---|---|
| 5,364,995 | A | 11/1994 | Kirkwood et al. |
| 5,447,622 | A | 9/1995 | Kerby et al. |
| 5,744,668 | A | 4/1998 | Zhou et al. |
| 6,792,881 | B2 | 9/2004 | Smith |
| 6,797,155 | B1 | 9/2004 | Chester et al. |
| 7,303,649 | B2 | 12/2007 | Brelid et al. |
| 7,503,981 | B2 | 3/2009 | Wyman et al. |
| 8,101,024 | B2 | 1/2012 | Wyman et al. |
| 8,895,790 | B2 | 11/2014 | Narayanaswamy et al. |
| 9,109,049 | B2 | 8/2015 | Kuzhiyil et al. |
| 9,212,318 | B2 | 12/2015 | Narayanaswamy et al. |
| 9,428,695 | B2 | 8/2016 | Narayanaswamy et al. |
| 9,468,950 | B2 | 10/2016 | Powell et al. |
| 10,233,395 | B2 | 3/2019 | Ward et al. |
| 10,266,774 | B2 | 4/2019 | Flores, III et al. |
| 10,336,628 | B2 | 7/2019 | Shi et al. |
| 10,442,997 | B2 | 10/2019 | Narayanaswamy et al. |
| 10,767,127 | B2 | 9/2020 | Sorenson |
| 10,822,562 | B2 | 11/2020 | Sorenson |
| 2011/0163002 | A1 | 7/2011 | White et al. |
| 2015/0166683 | A1 | 6/2015 | Haan et al. |
| 2016/0096994 | A1* | 4/2016 | Flores, III ..... C10G 1/086 585/242 |
| 2016/0264874 | A1 | 9/2016 | Narayanaswamy et al. |
| 2016/0264885 | A1 | 9/2016 | Narayanaswamy et al. |
| 2017/0247617 | A1 | 8/2017 | Schenk et al. |
| 2018/0371325 | A1 | 12/2018 | Streiff et al. |
| 2018/0371327 | A1 | 12/2018 | Streiff et al. |

OTHER PUBLICATIONS

Huber et al, "Synthesis of Transportation Fuels from Biomass: Chemistry, Catalysts, and Engineering," Chem. Rev., vol. 106 (2006).

Toyo Engineering, Generic process flow diagram for steam cracker reactor, Internet, https://www.toyo-eng.com/kr/en/business/petrochemical/ethylene/.

Kirk-Othmer Encyclopedia of Chemical Technology (online), vol. 11, Hoboken, N.J.: Wiley-Interscience (2001).

International Search Report and Written Opinion from International Application No. PCT/US2020/017031 dated Jul. 2, 2020.

International Preliminary Report on Patentability in Application No. PCT/US2020/017031 dated Nov. 16, 2021.

Translation of JP 2000024622 A.

Translation of CN 106520174 A.

First Office Action in Japanese Patent Application No. JP2021568183A dated Jan. 29, 2024.

Translation of First Office Action in Japanese Application No. JP2021568183A dated JP2021568183A.

Second Office Action in European Patent Application No. EP20709917.7A dated Oct. 8, 2024.

* cited by examiner

OLEFIN AND AROMATICS PRODUCTION BY THE CATALYTIC PYROLYSIS OF POLYMERS

RELATED APPLICATIONS

This application claims the priority benefit of provisional U.S. Patent Application Ser. No. 62/847,933 filed 14 May 2019.

FIELD OF THE INVENTION

This invention relates to the conversion of waste plastics, polymers, and other waste or biomass materials to useful chemical and fuel products such as paraffins, olefins, and BTX with minimal or no consumption of energy from external sources.

INTRODUCTION

In 2018, plastics generation in the United States was 38.5 million tons, which was 13.1 percent of MSW generation. World-wide over 350 million tons of plastics were produced. Plastic recycling recovers scrap or waste plastic and reprocesses the material into useful products. However, since China banned the import of waste plastics the recycle rate in the US is estimated to have dropped to only 4.4%. Plastic recycling is challenging because of the chemical nature of the long chain organic polymers and low economic returns. In addition, waste plastic materials often need sorting into the various plastic resin types, e.g. low density polyethylene (LDPE), high density polyethylene (HDPE), polypropylene (PP), polystyrene (PS), polyvinyl chloride (PVC), and polyethylene-terephthalate (PET) for separate recycling treatments.

Bio-TCat™ is the catalytic pyrolysis technology to convert renewable biomass materials to a mixed product of permanent gases, C2-C4 light olefins, C1-C4 light paraffins, and C5+ hydrocarbons including benzene, toluene, and xylenes ("BTX") aromatic and non-aromatic naphtha range molecules, C11+ hydrocarbons, coke and char, and minor byproducts. Conversion occurs in a fluid bed reactor using ZSM-5 zeolite or similar catalyst. A portion of the light gases produced by the reaction may be recycled to the reactor to provide fluidization gas and for biomass feedstock injection into the vessel. Coke and char by-products that accumulate on the catalyst and temporarily deactivate it are removed by oxidation in a continuously operating catalyst regenerator. Waste materials which can be processed by Bio-TCat include biomass, waste tires, lubricating oils, coal, and petroleum residues.

A new technology is Plas-TCat™ which is also a catalytic fluid bed process using zeolite catalysts, but the feedstock is polymer/plastic material, especially waste plastics that otherwise might be sent to a landfill or incinerator. Plastic mixtures that have relatively high hydrogen to carbon molar ratio and exclude chlorine and nitrogen, such as polyethylene (PE), polypropylene, polystyrene, and combinations can be converted to olefins and aromatics, but the process requires energy from an external source, such as fossil fuels, since combustion of the byproducts may not produce the energy required in the process.

U.S. Pat. No. 5,158,983 teaches a process in which a mixture of waste plastics and scrap rubber tires can be directly converted to a high quality synthetic crude oil using an oil soluble catalyst under a high pressure of hydrogen. Small amounts of coke are formed.

U.S. Pat. No. 5,364,995 teaches a process for vaporizing plastics in the absence of a catalyst to produce light olefins, paraffins, naphthenes, olefin oligomers, and waxes. Further upgrading of the product stream by steam cracking is disclosed.

U.S. Pat. No. 8,895,790 describes a method of converting plastic to olefins and aromatics. In this patent the pyrolysis reactions are carried out above 550° C.

U.S. Pat. No. 9,428,695 describes a process for converting mixtures of plastics to olefins and aromatics using a fluidized bed of FCC and ZSM-5 catalysts in which the process may require supplemental heat input from an external heating source.

World patent WO 2017/103010 describes a method to convert plastic into products at the temperature range of below 500° C.

It is an object of the present invention to provide for the conversion of waste plastics, polymers, and other materials to useful chemical and fuel products such as paraffins, olefins, and BTX with minimal or no consumption of energy from external sources.

SUMMARY OF THE INVENTION

In a first aspect of this invention a mixture comprising polymers is converted in a fluid bed catalytic pyrolysis process to produce olefins, aromatics, coke, gases, and other byproducts, wherein the energy produced from combustion of the coke or coke and other byproducts in a catalyst regenerator or by other means is at least equal to the energy required for operation of the pyrolysis process.

In another aspect, the invention provides a method of converting plastics to olefins, comprising: feeding a polymer or mixture of polymers to a reactor; pyrolyzing the material within the reactor in the presence of a catalyst under reaction conditions sufficient to produce a gaseous raw product mixture comprising one or more olefins. In some embodiments, this method can be characterized by one or any combination of the following features: where a plurality of the olefins are produced and the olefins are separated from the gaseous raw product mixture for subsequent conversion in another process; wherein the olefin conversion process comprises: hydrogenation, hydrolysis, hydroformylation, cyclization, dimerization, polymerization, or alkylation; wherein the olefin conversion process comprises one or any combination of the following steps: conversion of olefins to alcohols or ethers; low temperature (800° C.-400° C.) polymerization of olefins; reaction with CO to form carboxylic acids or aldehydes; alkylation with aromatics to form alkylated aromatics, and hydrogenation to paraffins; wherein the polymer or mixture of polymers is molten and further comprising filtering solids from the molten mixture prior to pyrolyzing; wherein the step of pyrolyzing comprises fast solid pyrolysis in the presence of a catalyst; wherein the catalyst comprises a zeolite; wherein the reaction is conducted in a fluidized bed, circulating bed, bubbling bed, or riser reactor at an operating temperature in the range from 300° C. to 1000° C., or from 400° C. to 650° C., or from 450° C. to 600° C., or from 500° C. to 575° C.; wherein the polymer or mixture of polymers comprises at least 80 mass % of polyethylene or polypropylene, or a combination of both; wherein the polymer or mixture of polymers comprises at least 80 mass % of PET or other polyesters; wherein the gaseous raw product mixture comprises at least 20 mass % olefins, or at least 50 mass % olefins, in some embodiments in the range of 20 to 90 mass % olefins; wherein the mass yield of olefins is at least 30%, or at least 40%, or at least 45%, or at least 50%, or at least 55%, or at least 60%, or from 20% to 70%, or from 30% to 65%, or from 45% to 60%, based on the mass in the polymer feed; wherein the reactor is a fluidized bed reactor; wherein the catalyst is a solid catalyst and the step of pyrolyzing comprises pyrolyzing in the presence of the solid catalyst in a fluidized bed reactor to produce a fluid product stream and used catalyst with coke, and wherein at least 95% the carbon in the feed is converted to coke and volatile products;

transferring at least a portion of the used catalyst with coke to a regenerator where the coke is reacted with oxygen to form hot regenerated catalyst and returning at least a portion of the hot regenerated catalyst to the fluidized bed reactor wherein heat from the hot regenerated catalyst provides energy to the step of pyrolyzing; wherein at least a portion of the gases in the product mixture are combusted in the regenerator;

wherein the gaseous raw product mixture is subjected to a separation process to produce a stream of gases enriched in CO and $H_2$; and passing at least a portion of the stream of gases enriched in CO and $H_2$ to the regenerator where they are combusted; wherein the polymer or mixture of polymers comprises polyethylene, or polypropylene, or polystyrene, or mixtures thereof; wherein the gaseous raw product mixture comprises H2 and CO; and wherein 10 to 25 mass % of the H2 and CO is combusted in the regenerator. As with all the descriptions of the invention, in some embodiments, the term "comprises" may be replaced by the term "consists essentially of" or "consists of".

In another aspect, the invention provides a method of catalytically pyrolyzing a mixed feed of materials, comprising: providing a first stream comprising a polymer; adding a coke-forming material to form a mixed feed of materials; adding the mixed feed of materials to a fluidized bed reactor; pyrolyzing the mixed feed in the presence of a solid catalyst in the fluidized bed reactor to produce a fluid product stream and used catalyst with coke, and wherein at least 95% of the carbon in the mixed feed is converted to coke and volatile products; transferring at least a portion of the used catalyst with coke to a regenerator where the coke is reacted with oxygen to form hot regenerated catalyst and returning at least a portion of the hot regenerated catalyst to the fluidized bed reactor wherein heat from the hot regenerated catalyst provides energy to the step of pyrolyzing; and wherein either (a) heat from combusting the coke provides at least 90% of the energy to the step of pyrolyzing, wherein the first stream has the property such that if a stream consisting of only the first stream would be subjected to the step of pyrolyzing and if all of the used catalyst with coke would be transferred to the regenerator where the coke is combusted with oxygen to form the hot regenerated catalyst and hot combustion gases and returning all of the hot regenerated catalyst to the fluidized bed reactor wherein the heat from the hot regenerated catalyst provides energy to the step of pyrolyzing, then the heat provided by the combustion of the coke, including heat of the catalyst and heat recovered from the combustion gases, provides energy that would be less than the minimum energy required for the catalytic pyrolysis process in which at least 95% of the carbon in the first stream is converted to coke and volatile products; or (b) heat from combusting coke and a portion of the volatile products provides at least 90% of the energy to the step of pyrolyzing, wherein the first stream has the property such that if a stream consisting of only the first stream would be subjected to the step of pyrolyzing and if all of the used catalyst with coke and the portion of the volatile products would be transferred to the regenerator where the coke and the portion of the volatile products is combusted with oxygen to form the hot regenerated catalyst and hot combustion gases and returning all of the hot regenerated catalyst to the fluidized bed reactor wherein the heat from the hot regenerated catalyst provides energy to the step of pyrolyzing, then the heat provided by the combustion of the coke, including heat of the catalyst and heat recovered from the combustion gases, provides energy that would be less than the minimum energy required for the catalytic pyrolysis process in which at least 95% of the carbon in the first stream is converted to coke and volatile products; and wherein the addition of the coke-forming materials to the mixed feed results in sufficient coke to provide at least the minimum energy required for a catalytic pyrolysis process in which at least 95% of the carbon in the mixed feed is converted to coke and volatile products. Note that these calculations are conducted assuming that the mixed feed is added to the fluidized bed reactor at a constant rate.

The aspect can be further characterized by one or any combination of the features mentioned above or can be further characterized by one or any combination of the following features: wherein heat from combusting coke and a portion of the volatile products provides at least 90% of the energy to the step of pyrolyzing and wherein the portion of the volatile products combusted comprises a CO and H2 enriched stream separated from the volatile products; wherein heat from combusting coke and a portion of the volatile products provides at least 90% of the energy to the step of pyrolyzing and wherein the portion of the volatile products combusted comprises a fraction of the gas mixture recovered after removing C5+ products from the volatile products; wherein the mixed feed materials are selected from biomass, polyethylene (PE), polypropylene (PP), polyacetylene, polybutylene, polyolefins, polyethylene terephthalate (PET), polybutyleneterephthalate, copolyesters, polyester, polycarbonate, polyurethanes, polyamides, polystyrene (PS), polyacetal, epoxies, polycyanurates, polyacrylics, polyurea, vinyl esters, polyacrylonitrile, polyvinyl alcohol, polyvinylchloride (PVC), polyvinyl acetate, nylon, copolymers such as: ethylene-propylene, EPDM, acrylonitrile-butadiene-styrene (ABS), nitrile rubber, natural and synthetic rubber, tires, styrene-butadiene, styrene-acrylonitrile, styrene-isoprene, styrene-maleic anhydride, ethylene-vinylacetate, nylon 12/6/66, filled polymers, polymer composites, plastic alloys, other polymeric materials, and polymers or plastics dissolved in a solvent, whether obtained from polymer or plastic manufacturing processes as waste or discarded materials, post-consumer recycled polymer materials, materials separated from waste streams such as municipal solid waste, black liquor, wood waste, or other biologically produced materials, or some combination of these; wherein the polymer is selected from among polyethylene, polypropylene, and polystyrene, or mixtures thereof, and the high coke-forming material is selected from among biomass, polyethyleneterephthalate, tires, cellulose, cellulose acetate, cotton clothing, and nylon, or mixtures thereof; wherein the reaction is conducted in a fluidized bed, circulating bed, bubbling bed, or riser reactor at an operating temperature in the range from 300° C. to 1000° C., or from 400° C. to 650° C., or from 450° C. to 600° C., or from 500° C. to 575° C.; wherein a stream enriched in ethylene or propylene, or both is separated from the volatile products; wherein the volatile products comprise at least 10 mass % olefins, or at least 20 mass % olefins, in some embodiments in the range of 5 to 90 mass % olefins; wherein a stream comprising C5+ products is separated from the volatile products; wherein a stream enriched in benzene, toluene, xylenes, or some combination of these is separated from the volatile products; wherein the mass yield of BTX is at least 10%, or at least 20%, or at least 25%, or at least 30%, or at least 35%, or at least 40%, or from 10% to 70%, or from 20% to 65%, or from 25% to 60%, based on the mass in the polymer feed; and wherein the mixed feed comprises from 5 to 98 or 5 to 90, or 20 to 70 or 20 to 90 or 40 to 90 or 40 to 60 mass % of PE, PP, PS or mixtures thereof; and the balance of the mixed feed comprises at least 95 mass % high coke-forming materials; wherein the mixed feed comprises from 5 to 98 or 5 to 90, or 20 to 70 or 20 to 90 or 40 to 90 or 40 to 60 mass % of PE, PP, PS or mixtures thereof; and from 2 to 60 or 10 to 60 or 10 to 50 or 15 to 25 or 2 to 15 or 2 to 6 or 2 to 5 or 3 to 4 mass % high coke forming materials, or 20 to 60 or 4 to 15 mass % PET, or 2 to 50 or 10 to 50 or 2 to 3 mass % biomass, or 2 to 55 or 10 to 50 or 40 to 55 or 5 to 20 or 2 to 5 mass % tire polymer (not including mass of contaminants).

In yet another aspect, the invention provides a method of catalytically pyrolyzing a mixed feed of materials, comprising: adding a first stream comprising a polymer into a fluidized bed reactor; pyrolyzing the polymer in the presence of a solid catalyst in the fluidized bed reactor to produce a fluid product stream and used catalyst with coke, and wherein at least 95% of the carbon in the mixed feed is converted to coke and volatile products; transferring at least a portion of the used catalyst with coke to a regenerator where the coke is reacted with oxygen to form hot regenerated catalyst and returning at least a portion of the hot regenerated catalyst to the fluidized bed reactor wherein heat from the hot regenerated catalyst provides energy to the step of pyrolyzing; and wherein the first stream has the property such that if a stream consisting of only the first stream would be subjected to the step of pyrolyzing and if all of the used catalyst with coke would be transferred to the regenerator where the coke is combusted with oxygen to form the hot regenerated catalyst and hot combustion gases and returning all of the hot regenerated catalyst to the fluidized bed reactor wherein the heat from the hot regenerated catalyst provides energy to the step of pyrolyzing, then the heat provided by the combustion of the coke, including heat of the catalyst and heat recovered from the combustion gases, provides energy that would be less than the minimum energy required for the catalytic pyrolysis process in which at least 95% of the carbon in the first stream is converted to coke and volatile products; and introducing an amount of oxygen into the first stream such that there is sufficient energy to convert at least 95% of the carbon in the first stream to coke and volatile products.

The aspect can be further characterized by one or any combination of the features mentioned above or can be further characterized by one or any combination of the following features: wherein the amount of oxygen introduced into the process stream is from 0.6% to 10%, 0.6% to 8%, 1% to 6%, or from 2% to 4% by weight, or at least 0.5%, at least 2%, at least 4%, or at least 6% by weight of the mass of the first stream; wherein the oxygen is introduced by the addition of air or O2 preferably as a component of the fluidization fluid, or with the gas injected with the plastics, or by separate, direct injection into the fluidized bed, or some combination thereof.

In another aspect, the invention provides a method of catalytically pyrolyzing a feed comprising a polymer in a fluidized bed reactor wherein the amount of oxygen introduced into the process is at least enough such that combustion of feed materials or other components with the introduced oxygen increases the temperature of the reacting mixture by at least 25° C., or at least 100° C., or at least 200° C., or at least 300° C., or from 100° C. to 400° C. In some embodiments, the amount of oxygen introduced into the process stream is from 0.6% to 10%, 0.6% to 8%, 1% to 6%, or from 2% to 4% by weight, or at least 0.5%, at least 2%, at least 4%, or at least 6% by weight of the mass of the mixed feed. In some embodiments, the oxygen is introduced by the addition of air or O2 preferably as a component of the fluidization fluid, or with the gas injected with the plastics, or by separate, direct injection into the fluidized bed, or some combination thereof.

In a further aspect, the invention provides a method of producing aromatics, or olefins, or a mixture thereof comprising: feeding a polymer or mixture of polymers to a fluidized bed, circulating bed, bubbling bed, or riser reactor; pyrolyzing the material within the reactor in the presence of a catalyst under reaction conditions sufficient to produce a gaseous raw product mixture comprising one or more olefins, or one or more aromatics, or both, and introducing at least a fraction of the gaseous raw product mixture into a process stream in a steam cracking facility.

The aspect can be further characterized by one or any combination of the features mentioned above or can be further characterized by one or any combination of the following features: further comprising separating a stream enriched in olefins, aromatics, or both into a stream in a stream cracking facility; further comprising separating and purifying the olefins, or the aromatics, or both the olefins and aromatics in the steam cracking facility; wherein catalyst circulating in the catalytic pyrolysis unit is heated by steam cracker product gas and at least a portion thereof is recycled to the catalytic pyrolysis process reactor; wherein hot vapor products from the catalytic conversion of plastics are introduced into the quench tower of a steam cracking facility along with steam cracker gas and vapor products; wherein at least a portion of the methane produced in a steam cracking facility is included as the fluidization fluid of a plastics catalytic pyrolysis process; wherein hydrogen produced in the steam cracking process, or hydrogen produced in the catalytic pyrolysis, or some combination thereof, is used in the inventive process either (a) to hydrogenate acetylene, methyl acetylene/propadiene, pygas, or other products, or some combination thereof, or (b) to hydrotreat aromatics, paraffins, or some combination thereof, to reduce sulfur, nitrogen, oxygen, triene, diene, and styrene contents thereof, or (c) some combination of hydrogenation and hydrotreating; wherein at least a portion of a stream comprising ethane and propane, or C4 olefins and paraffins, or a combination of them, is recycled to the steam cracker to produce additional ethylene and propylene, or is recycled to the plastic catalytic pyrolysis reactor as a component of the fluidization gas; wherein at least a portion of the pygas naphtha and a portion of the condensable stream of naphtha from the plastic catalytic pyrolysis is hydrotreated to reduce the concentration of dienes, trienes, acetylenes, or vinyl aromatics (e.g. styrene) or some combination thereof, and reduce the concentrations of trace heteroatoms sulfur, nitrogen, chlorine, or oxygen, or some combination thereof; wherein the hydrotreated products are further separated and purified to produce polymer-grade benzene, toluene, p-xylene, or some combination thereof; wherein the catalyst used in the catalytic pyrolysis comprises a zeolite; wherein the zeolite has a constraint index in the range 1 to 12; wherein the zeolite is ZSM-5; wherein at least a portion of the feed mixture is heated to provide a molten mass that is hot filtered to remove suspended solids; wherein the step of pyrolyzing comprises fast solid pyrolysis in the presence of a catalyst; wherein the catalyst comprises a zeolite; wherein the catalytic pyrolysis reaction is conducted in a fluidized bed, circulating bed, bubbling bed, or riser reactor at an operating temperature in the range from 300° C. to 1000° C., or from 400° C. to 650° C., or from 450° C. to 600° C., or from 500° C. to 575° C.

In another aspect, the invention provides a feed mixture for a catalytic pyrolysis process comprising, 10 to 95 or at least 10, 20, 30, 50, 60, or 10 to 80 mass % polymers, and the balance is at least 95 mass % high coke-forming materials. In some embodiments, at least 5%, or at least 10%, or at least 20%, or at least 30%, or at least 40% or at least 50%, or from 5% to 60%, or from 10% to 60%, or from 20% to 60%, or from 40% to 60% by mass of the feed comprises high coke-forming material. In some preferred embodiments, the polymers comprise polyethylene, polypropylene, polystyrene, or some combination thereof. In some embodiments, the high coke-forming material is biomass, tire sidewall, tire tread, or some combination thereof. In some embodiments, the mixture comprises 0.1% to 3%, or 0.2% to 2%, or 0.4% to 1%, or at least 0.1%, or at least 0.2% or at least 0.3%, or at least 0.5%, or less than 3%, or less than 2%, or less than 1% by weight contaminants.

In another aspect, the invention provides a feed mixture for a catalytic pyrolysis process comprising, 10 to 99 or at least 30, 50, 80, 90 or 50 to 99 mass % of the polymers polyethylene, polypropylene, polystyrene, or mixtures thereof, and at least 1%, or at least 2%, or at least 3%, or at least 4%, or at least 10%, or from 0.5% to 20%, or from 1% to 15%, or from 2% to 13%, by mass high coke-forming material, wherein the sum of the masses of the polymers and high coke-forming material is 100 mass %.

The aspect can be further characterized by one or any combination of the following features: wherein the high coke-forming material is biomass, cellulose, cotton clothing, PET, PET clothing, cellulose acetate, or some combination of these; wherein the mixture comprises 1% to 10%, or 2% to 8%, or 4% to 7%, or at least 1%, or at least 2% or at least 3%, or at least 5%, by weight contaminants prior to any contaminant removal process; wherein the high coke-forming material is pretreated at least in part to reduce contaminant concentrations in a contaminant removal process before addition to a catalytic pyrolysis process; wherein at least 5%, or at least 10%, or at least 20%, or at least 30%, or at least 40% or at least 50%, or from 5% to 60%, or from 10% to 60%, or from 20% to 60%, or from 40% to 60% by mass of the feed comprises high coke-forming material, and the balance is at least 95 mass % polymers.

The invention also includes systems comprising these feed mixtures and a pyrolysis reactor. For example, any of the feed mixtures described herein inside of any of the reactor types described herein. The systems may be further characterized by any of the conditions described herein.

In any of the inventive aspects, the term "coke" includes both coke and char. Typically, very little char is formed in the catalytic pyrolysis of plastics.

The present invention provides an efficient, eco-friendly, and cost-effective method for recycling waste plastic to produce useful chemicals without the need of supplying energy from external sources.

DETAILED DESCRIPTION

Figure 1:
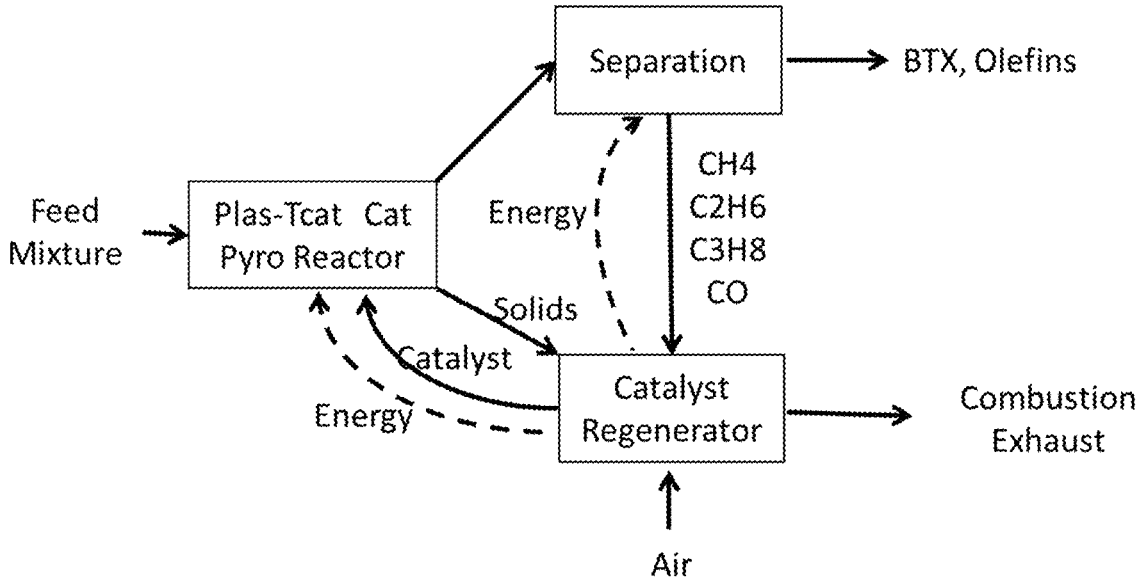
FIG. 1 presents a schematic of the energy recovery and integration scheme in a process for converting plastic to useful products such as BTX and olefins.

A mixture of feed materials may comprise waste plastics, polymers, or other materials such that the combustion of selected byproducts of the catalytic pyrolysis in a catalyst regenerator or otherwise generates sufficient energy to drive the catalytic pyrolysis conversion process, the separation of valuable products of the catalytic pyrolysis conversion process, the upgrading of catalytic pyrolysis conversion products, or some combination of these. In some embodiments, the energy derived from the combustion of the byproducts exceeds the energy required within the plant and energy may be converted to electrical energy for export to the grid or other places.

In some embodiments any of the aspects of the invention may be characterized by one or any combination of the following characteristics: the polymer is selected from among polyethylene, polypropylene, polystyrene, or mixtures thereof; the feed mixture to the catalytic pyrolysis process may comprise biomass, polyethyleneterephthalate, tires, cellulose, cellulose acetate, cotton clothing, and nylon, or mixtures thereof; the mixture of feed materials is chosen such that the amount of solid carbonaceous products, such as coke and char, produced in the catalytic pyrolysis process, is at least sufficient to provide the energy required in the process upon combustion of the solids in a catalyst regenerator or otherwise; the mixture of feed materials is chosen such that the amount of solid carbonaceous products and a portion of the gaseous products produced in the catalytic pyrolysis process is at least sufficient to provide the energy required in the process upon combustion in a catalyst regenerator or otherwise; the mixture of feed materials is chosen such that the amount of solid carbonaceous products and a portion of an olefin depleted mixture of gases separated from the gaseous products produced in the catalytic pyrolysis process is at least sufficient to provide the energy required in the process upon combustion in a catalyst regenerator or otherwise.

In one aspect, an olefin stream is produced by the catalytic pyrolysis of polymers and is separated for upgrading to valuable products. In another aspect, the invention provides a method for producing one or more olefin products from a polymer material or co-mingled polymeric material. Thus, the invention has particular utility in the recycling of plastics. In this method, a polymer or, more typically, a mixture of polymers is fed to a reactor, and at least a portion of the material is pyrolyzed within the reactor in the presence of a catalyst under reaction conditions sufficient to produce one or more olefins. In some preferred embodiments, the invention can be characterized by surprisingly high yields of ethylene and/or propylene. The olefins can be separated from the gaseous raw product mixture for subsequent conversion in another process. The olefin conversion process could include, for example: hydrogenation, hydrolysis, hydroformylation, cyclization, dimerization, polymerization, alkylation, or other conversion process or combination of conversion processes. However, the invention is not limited to these conversion processes. In some embodiments, the conversion process comprises one or any combination of the following steps: conversion of olefins to alcohols or ethers; low temperature (80-400° C.) polymerization of olefins; reaction with CO to form carboxylic acids or aldehydes; alkylation with aromatics to form alkylated aromatics, and hydrogenation to paraffins.

A gaseous product stream from the catalytic pyrolysis process can be separated into an olefin poor stream and an olefin rich stream and at least a portion of the olefin rich stream coming from an olefins separator purified before being converted to high value products.

In some embodiments, the gaseous raw product mixture (the vapor phase product leaving the fluidized bed reactor prior to any separation steps that occur outside the reactor) produced by the method comprises at least 20 mass % olefins, or at least 50 mass % olefins, in some embodiments in the range of 20 to 90 mass % olefins.

In some embodiments the mass yield of olefins is at least 30%, or at least 40%, or at least 45%, or at least 50%, or at least 55%, or at least 60%, or from 20% to 70%, or from 30% to 65%, or from 45% to 60%, based on the mass in the polymer feed.

The process may produce a BTX mixture upon separation of the products. In some embodiments the mass yield of BTX is at least 10%, or at least 20%, or at least 25%, or at least 30%, or at least 35%, or at least 40%, or from 10% to 70%, or from 20% to 65%, or from 25% to 60%, based on the mass of the polymer feed.

The invention also includes chemical systems comprising the apparatus and compositions described herein. The invention further includes the chemical compositions that occur as intermediates or final products that are described herein or that result from the methods described herein. For example, the invention includes olefin conversion products that additionally comprise polyolefins, alcohols, aldehydes, acids, or other higher value chemicals.

In some embodiments, the feed composition comprises a mixture of polymeric material and a catalyst. The mixture may comprise, for example, solids, liquids, and/or gases. In certain embodiments, the mixture comprises a composition of a solid catalyst and a solid polymeric material. In other embodiments, a catalyst may be provided separately from the polymer feed stream.

In some embodiments, for example when recycled polymeric materials are used, impurities may optionally be removed from the feed composition prior to being fed to the reactor, e.g., by an optional purification step. In some instances, the particle size of the solid polymer feed composition may be reduced in a size reduction system prior to passing the feed to the catalytic pyrolysis reactor. In some embodiments, the average diameter of the reduced size feed composition exiting the size reduction system may comprise no more than about 50%, not more than about 25%, no more than about 10%, no more than about 5%, no more than about 2% of the mass average diameter of the feed composition fed to the grinding system. The feed mixture may comprise plastics mixtures in which at least 85% by mass, or at least 90% by mass, or at least 95% by mass of the particles pass through a 0.25 inch (0.6 cm), or 0.5 inch (1.2 cm), or 1.0 inch (2.5 cm), or 1.5 inch (3.7 cm), or 2 inch (5.0 cm) screen or wherein the feed comprises plastics mixtures in which at least 85% by mass, or at least 90% by mass, or at least 95% by mass of the particles have aspect ratios (ratio of length to width) of 2:1, or 3:1, or 5:1, or 10:1, or 40:1, or 77:1, or from 1:1 to 100:1, or from 1.5:1 to 40:1, or from 2:1 to 10:1. Average diameter (size) can be measured by sieving through mesh (screen). Large-particle feed material may be more easily transportable and less difficult to process than small-particle feed material. On the other hand, in some cases it may be advantageous to feed small particles to the reactor (as discussed below). The use of a size reduction system allows for the transport of large-particle feed between the source and the process, while enabling the feed of small particles to the reactor.

In processes in which catalyst from the catalytic pyrolysis is regenerated, heat is generated by the oxidation of coke, char, and other materials in a catalyst regenerator for use in the process, or for conversion to electricity for export. In one set of embodiments, an oxidizing agent is fed to the regenerator via a stream shown as 'air' in FIG. 1. The oxidizing agent may originate from any source including, for example, a tank of oxygen, atmospheric air, steam, among others. In the regenerator, the catalyst is re-activated by reacting the catalyst with the oxidizing agent and heat is generated. A solid mixture comprising deactivated catalyst may comprise residual carbon and/or coke as well as coke or char from the process, which may be removed via reaction with the oxidizing agent in the regenerator. In some embodiments a portion of the gaseous products from the catalytic pyrolysis process is fed to the catalyst regenerator to be combusted with the solid materials. The gaseous products may be first separated into an olefin rich stream and an olefin poor stream and at least a portion of the olefin poor stream is fed to the catalyst regenerator. The regenerator in FIG. 1 comprises a vent stream which may include regeneration reaction products, residual oxidizing agent, etc.

FIG. 1 presents a schematic of the process of the present invention. A feed mixture of plastics and other materials is supplied to a Plas-TCat fluidized bed catalytic pyrolysis reactor where it is reacted to form a vapor product stream and a solid catalyst containing stream. The catalyst containing stream is passed to a catalyst regenerator in which it is contacted with an oxidizing gas such as air to regenerate the catalyst and produce energy from the combustion. Energy for use in the process, e.g., for heating feed materials or recycle gases or other purposes, may be recovered from the hot combustion gases produced in the regenerator, by heat exchange in one or more heat exchangers. The vapor product stream from the catalytic pyrolysis is separated into valuable product streams containing olefins and aromatics, and a byproduct stream containing methane, ethane, propane, H2, CO2, and CO. Optionally a portion of the byproduct gas stream can be passed to the regenerator to increase the heat generation therein. A portion of the energy generated in the catalyst regenerator can be used as thermal energy in the catalytic pyrolysis reactor, or for products separation, or both, or the energy can be converted to electrical energy, or the generated energy can be used as thermal energy and electrical energy within the plant or exported. At least a portion of the regenerated catalyst is returned to the catalytic pyrolysis reactor.

As shown in the illustrative embodiment of FIG. 1, the regenerated catalyst may exit the regenerator and may be recycled back to the catalytic pyrolysis reactor via a recycle stream. In some cases, catalyst may be lost from the system during operation. In some such and other cases, additional "makeup" catalyst may be added to the system via a makeup stream. Although not illustrated in FIG. 1, the regenerated and makeup catalyst may be fed to the reactor with the fluidization fluid via a recycle stream, although in other embodiments, the catalyst and fluidization fluid may be fed to the reactor via separate streams.

Figure 2:
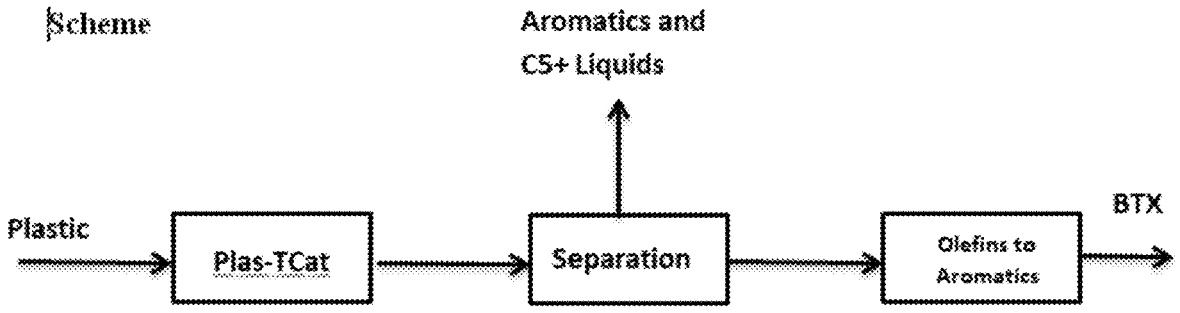
FIG. 2 presents a schematic of the process in which the olefins are separated from the product mixture and upgraded to BTX.

The olefins can be separated from the product mixture of polymer conversion and upgraded to BTX in a separate process as shown in FIG. 2. Unconverted olefins from the olefins to aromatics step may be recycled to the olefins to aromatics process, although this is not shown in the Figure. In this embodiment of the invention the product streams from the Plas-TCat reactor and Olefins to Aromatics processes can be separately handled, allowing more flexibility in the purification of the products or other opportunities for integration with other facilities. The olefin to aromatic conversion process could be one that is shared with another process or is an existing plant for which the yield or efficiency is increased by the integration with the inventive process. Advantages include a reduced need for infrastructure and a less costly and energy intensive separation scheme.

Figure 3:
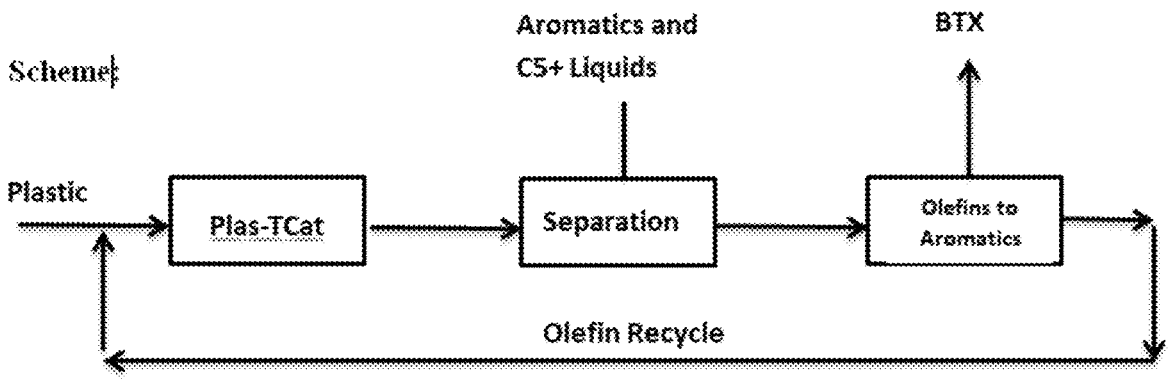
FIG. 3 shows a schematic of the process in which olefins are separated from the products for upgrading to BTX and the unconverted olefins are recycled to the catalytic pyrolysis reactor.

FIG. 3 shows an embodiment of the process in which olefins are separated from the catalytic pyrolysis products for upgrading to BTX and at least a portion of the unconverted olefins are recycled to the catalytic pyrolysis (Plas-TCat) reactor. This configuration of the inventive process takes advantage of the capability of the Plas-TCat process to convert olefins to aromatics, boosting the yield of aromatics obtained from the Plas-TCat reactor, and improving the efficiency of the overall process. In this embodiment of the invention the products of the Plas-TCat and olefins to aromatics processes may be handled separately or combined for purification and separation into the desired high value products.

Figure 4:
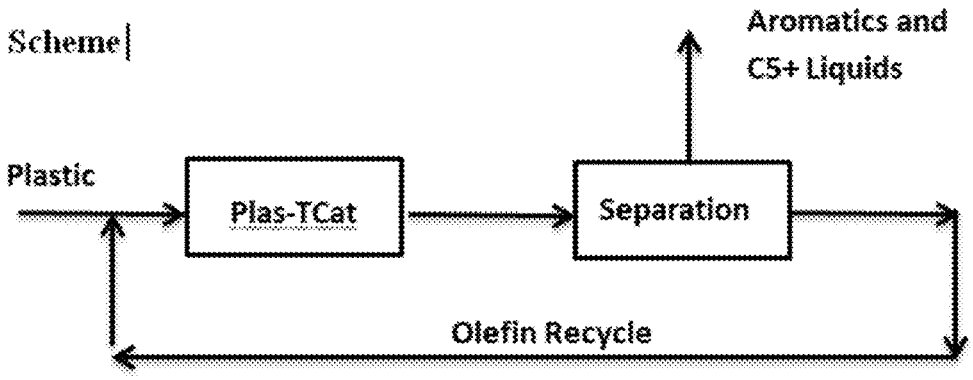
FIG. 4 presents a schematic of the process in which olefins are separated from the products and recycled to the catalytic pyrolysis reactor for further processing.

Another embodiment of the inventive process is presented in FIG. 4 in which at least a portion of the olefins produced are separated from the products of the Plas-TCat process and recycled to the catalytic pyrolysis (Plas-TCat) reactor for further processing and conversion to useful products. In this embodiment the number of unit operations is minimized and the capital investment is reduced compared to some other embodiments of the process, and this embodiment may be more applicable to stand-alone plants where opportunities for integration with nearby processes are not available.

Figure 5:
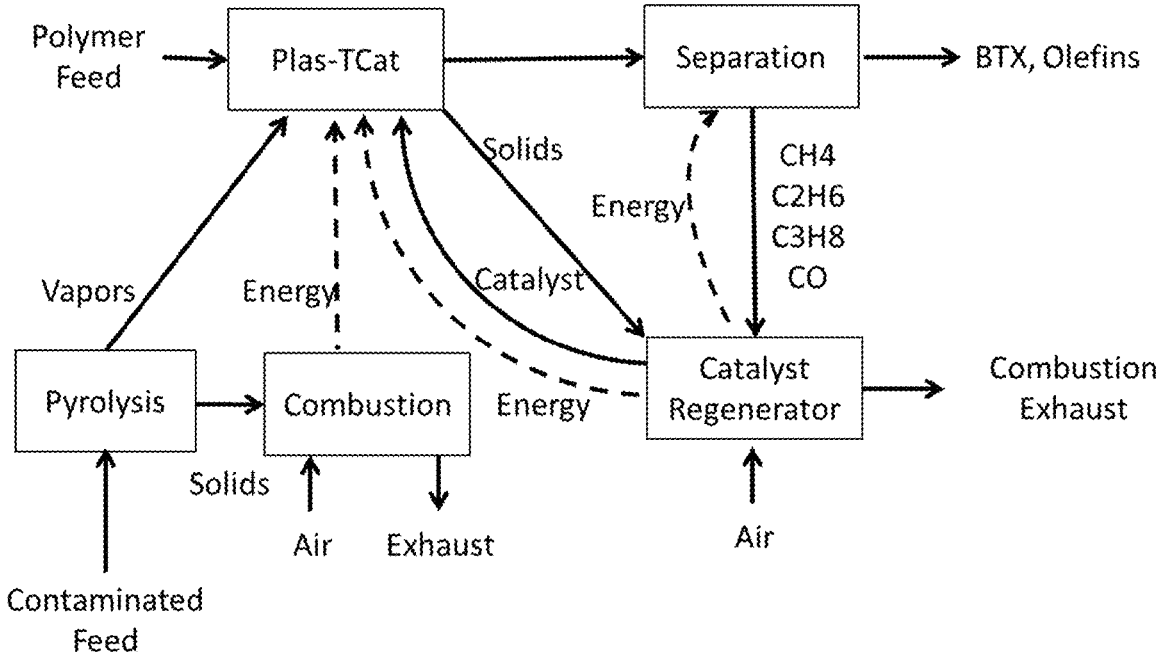
FIG. 5 shows a schematic of the process in which a coke-forming feed is pyrolyzed in a separate reactor, the vapors are introduced to the Plas-TCat process, and the solids are combusted separately to produce energy for the process.

In another embodiment of the inventive process a coke-forming feed is pyrolyzed in a separate reactor, the vapors from the pyrolysis are introduced to the Plas-TCat process, and the solids from the pyrolysis are combusted separately to produce energy for the process, as shown schematically in FIG. 5. This embodiment has the advantage of using feeds to the pyrolysis unit that contain contaminants that could damage or deactivate the Plas-TCat catalyst, or could otherwise present product purification and separation problems, or could simply build up in the process. In this scheme the non-volatile contaminants, e.g. silica, alumina, sand, etc., are largely retained in the solids and are not sent to the Plas-TCat process so the catalyst is not contaminated.

The mixed polymer feed to the process comprises one or any combination selected from the following materials: biomass, polyethylene (PE), polypropylene (PP), polyacetylene, polybutylene, polyolefins, polyethylene terephthalate (PET), polybutyleneterephthalate, copolyesters, polyester, polycarbonate, polyurethanes, polyamides, polystyrene (PS), polyacetal, epoxies, polycyanurates, polyacrylics, polyurea, vinyl esters, polyacrylonitrile, polyvinyl alcohol, polyvinylchloride (PVC), polyvinyl acetate, nylon, copolymers such as: ethylene-propylene, EPDM, acrylonitrile-butadiene-styrene (ABS), nitrile rubber, natural and synthetic rubber, tires, styrene-butadiene, styrene-acrylonitrile, styrene-isoprene, styrene-maleic anhydride, ethylene-vinylacetate, nylon 12/6/66, filled polymers, polymer composites, plastic alloys, other polymeric materials, and polymers or plastics dissolved in a solvent. The feed materials can comprise materials obtained from polymer or plastic manufacturing processes as waste or discarded materials, post-consumer recycled polymer materials, materials separated from waste streams such as municipal solid waste, black liquor, wood waste, or other biologically produced materials. The feed mixture comprises materials that, when subjected to catalytic pyrolysis in a fluidized bed reactor, produce sufficient coke and light gases such as CO, H2, CH4, C2H6, C3H8, such that when combusted in a catalyst regenerator or other device, the combustion of the coke, or coke and a portion of the light gases produces energy sufficient to sustain the catalytic pyrolysis process without addition of energy from external sources such as the combustion of natural gas, oil, coal, or other materials, or electrical energy, or energy produced from materials other than the byproducts of the inventive process.

In some embodiments the feed mixture comprises, in addition to polyethylene, polypropylene, polystyrene, or mixtures thereof, added high coke-forming materials such that at least 5%, or at least 10%, or at least 20%, or at least 30%, or at least 40% or at least 50%, or from 5% to 60%, or from 10% to 60%, or from 20% to 60%, or from 40% to 60% by mass of the feed mixture comprises material or materials that produces more than 1%, or more than 2%, or more than 5%, or more than 10%, or more than 20%, or more than 40%, or from 1% to 40%, or from 5% to 40%, or from 10% to 40% by weight coke and char in the catalytic pyrolysis of the added material in a standard drop tube experiment. The amount of coke and char is determined according to the method and conditions as set forth in the Examples section using ZSM-5 as the catalyst in a standard drop tube experiment. Unless otherwise specified, the phrase "standard drop tube experiment" refers to the methods and conditions as set forth in the examples using ZSM-5. Throughout this description, the phrase "coke and char" is the same as "coke" in the examples and refers to all carbonaceous black or grey solid material produced by pyrolysis.

In some embodiments the feed mixture comprises, in addition to polyethylene, or polypropylene, or polystyrene, or mixtures thereof, added high coke-forming materials such that at least 5%, or at least 10%, or at least 20%, or at least 30%, or at least 40% or at least 50%, or from 5% to 60%, or from 10% to 60%, or from 20% to 60%, or from 40% to 60% by mass of the feed mixture comprises material or materials that produces more than 1%, or more than 2%, or more than 5%, or more than 10%, or more than 20%, or more than 40%, or from 1% to 40%, or from 5% to 40%, or from 10% to 40% by weight coke and char in the catalytic pyrolysis of the added material in a standard drop tube experiment, and the added materials comprise 0.1% to 3%, or 0.2% to 2%, or 0.4% to 1%, or at least 0.1%, or at least 0.2% or at least 0.3%, or at least 0.5%, or less than 3%, or less than 2%, or less than 1% by weight contaminants.

In some embodiments the feed mixture comprises, in addition to polyethylene, or polypropylene, or polystyrene, or mixtures thereof, added materials such that at least 1%, or at least 2%, or at least 3%, or at least 4%, or at least 10%, or from 0.5% to 20%, or from 1% to 15%, or from 2% to 13%, by mass of the feed mixture comprises material or materials that produces more than 1%, or more than 2%, or more than 5%, or more than 10%, or more than 20%, or more than 40%, or from 5% to 40%, or from 10% to 25% by weight coke and char in the catalytic pyrolysis of the added material in a standard drop tube experiment.

In some embodiments the feed mixture comprises, in addition to polyethylene, or polypropylene, or polystyrene, or mixtures thereof, added high coke-forming materials such that at least 1%, or at least 2%, or at least 3%, or at least 4%, or at least 10%, or from 0.5% to 20%, or from 1% to 15%, or from 2% to 13%, by mass of the feed mixture comprises high coke-forming material or materials that produces more than 1%, or more than 2%, or more than 5%, or more than 10%, or more than 20%, or more than 40%, or from 5% to 40%, or from 10% to 25% by weight coke and char when the added material is catalytically pyrolyzed in a standard drop tube experiment, and the added materials comprise 1% to 10%, or 2% to 8%, or 4% to 7%, or at least 1%, or at least 2% or at least 3%, or at least 5%, by weight contaminants before any contaminant removal process.

In some embodiments the added materials used in the process are pretreated at least in part to reduce contaminant concentrations in a contaminant removal process before addition to the catalytic pyrolysis process. A "contaminant" is a material such as silica or metal or metal oxide that does not pyrolyze under typical pyrolysis conditions. Removal can be accomplished by filtering off solids from a solution or melt, or in some preferred embodiments, by a first pyrolysis step, without added catalyst (or without zeolite catalyst) and, in some embodiments, where the first pyrolysis step is not in a fluidized bed. The contaminant removal process can be any of those such as washing with water or a solvent, and by those described in U.S. Pat. Nos. 10,336,628, 6,792,881, 7,303,649, 7,503,981, 8,101,024, 9,109,049, 9,468,950, and US Patent Application Publication US 2015/0166683, or any method known to those skilled in the art.

Preferred compositions of the feed may be approximated by calculating a linear combination of the yields of coke or the coke and a portion of the byproduct gases from each of the components of the feed, and comparing the energy produced by combustion of that coke and byproduct gas mixture with the energy required for the catalytic pyrolysis process that can also be calculated from the components of the feed mixture and processing steps. The energy required for the catalytic pyrolysis process can be approximated by the sum of 1) the energy difference between the heats of formation of the products and the heats of formation of the feed materials and 2) the energy lost in the conversion process and the energy required for the conversion and separations and purification processes.

In some embodiments, it may be advantageous to feed the polymers at least in part as a molten material. This can be done with polymers or plastics alone or as mixtures of polymers and plastics that melt at temperatures below 200° C. In some embodiments the molten polymers may be atomized before entrance into the pyrolysis reactor. This can be done with a carrier gas input or gas mixture recycled from the pyrolysis product separation section. Gas mixtures can comprise argon, helium, nitrogen, carbon dioxide, carbon monoxide, hydrogen, methane, ethane, propane, ethylene, or propylene, or mixtures of these.

In some embodiments the molten mixture of polymers, or plastics, or polymers and plastics may be filtered to remove solids that do not readily melt at the chosen process conditions using any of the variety of filtering procedures known to those skilled in the art. In some embodiments in which the molten mixture of polymers, or plastics, or polymers and plastics, comprises materials that contain carbonaceous solids, these solids may be separated by hot filtration and optionally combusted to provide energy for the process.

The reactor used may be any suitable reactor known to those skilled in the art. For example, in some instances, the reactor may comprise a continuous stirred tank reactor (CSTR), a batch reactor, a semi-batch reactor, a fluidized bed reactor, or a fixed bed catalytic reactor, among others. In some cases, the reactor comprises a fluidized bed reactor, e.g., a circulating fluidized bed reactor, a moving bed reactor such as a riser reactor, or a bubbling bed reactor. Fluidized bed reactors may, in some cases, provide improved mixing of the catalyst and/or polymeric material during pyrolysis and/or subsequent reactions, which may lead to enhanced control over the reaction products formed. The use of fluidized bed reactors may also lead to improved heat transfer within the reactor. In addition, improved mixing in a fluidized bed reactor may lead to a reduction of the amount of coke adhered to the catalyst, resulting in reduced deactivation of the catalyst in some cases and higher yields of olefins and other desirable products. Throughout this specification, various compositions are referred to as process streams; however, it should be understood that the processes could also be conducted in batch mode.

Suitable methods for separating olefins from other fluid hydrocarbon products are known to those of ordinary skill in the art. For example, olefins can be separated from other fluid hydrocarbon products by cooling the product stream to a temperature that lies between the boiling points of the olefins and the other fluid hydrocarbon products. Optionally, an olefin separator can comprise a multi-stage separator. For example, the olefin separator can comprise a first separator that directly separates the gaseous products (including olefins) from liquid products (e.g., high boiling point materials such as benzene, toluene, xylenes, higher olefins, higher paraffins, etc.), and a second separator that separates at least a portion of the olefins from other gaseous products (e.g., gaseous aromatics, methane, hydrogen, nitrogen, HCl, HCN, NH3, CO2, CO, H2O, etc.). The methods and/or conditions used to perform the separation can depend upon the relative amounts and types of compounds present in the fluid hydrocarbon product stream, and one of ordinary skill in the art will be capable of selecting a method and the conditions suitable to achieve a given separation given the guidance provided herein.

In one set of embodiments separated catalyst may exit the catalytic pyrolysis reactor via a solids exit conduit. In some cases, the catalyst exiting the catalytic pyrolysis reactor may be at least partially deactivated. The separated catalyst may be fed, in some embodiments, to a regenerator in which any catalyst that was at least partially deactivated may be reactivated. In some embodiments, the regenerator may comprise an optional purge stream, which may be used to purge solids such as coke, ash, and/or catalyst from the regenerator.

The deactivated solid catalyst removed from the reactor may be mixed with solid carbon containing materials derived from the feed materials or that were in the feed mixture and have not been transformed in the catalytic pyrolysis process. For example, tires contain carbon black, which is a solid form of carbon that is not significantly transformed in the catalytic pyrolysis process. The carbon black that is mixed with the partially deactivated catalyst may be passed to the catalyst regenerator where it is oxidized (combusted) along with the coke on the catalyst and any char made in the process, to produce heat. The heat is recovered in the hot catalysts and from the combustion gases and can be used to provide thermal energy for the catalytic pyrolysis process or, optionally, converted to electrical energy for operation of equipment in the plant such as distillation towers, compressors, pumps, fans, controllers, or the like, or the electricity can be transmitted to other facilities or to the grid, or some combination of these.

In one set of embodiments, an oxidizing agent is fed to the regenerator via a gas feed stream. The oxidizing agent may originate from any source including, for example, a tank of oxygen, atmospheric air, recycled exhaust gas, or steam, among others. In the regenerator, the catalyst is re-activated by reacting the catalyst with the oxidizing agent. In some cases, the deactivated catalyst may comprise residual carbon and/or coke, which may be removed via reaction with the oxidizing agent in the regenerator. The regenerator comprises a vent stream which may include regeneration reaction products, residual oxidizing agent, etc. The exhaust gas vent stream from the regenerator may be passed through a catalytic exhaust gas cleanup system to further reduce the concentrations of CO and hydrocarbons to reduce emissions vented to the atmosphere. Portions of the exhaust gas vent stream may be recycled to the gas feed of the regenerator to control the heat release of the regeneration process.

The regenerator may be of any suitable size mentioned above in connection with the reactor or the solids separator. In addition, the regenerator may be operated at elevated temperatures in some cases (e.g., at least about 300° C., 400° C., 500° C., 600° C., 700° C., 800° C., or higher). The residence time of the catalyst in the regenerator may also be controlled using methods known by those skilled in the art, including those outlined above. In some instances, the mass flow rate of the catalyst through the regenerator will be coupled to the flow rate(s) in the reactor and/or solids separator in order to preserve the mass balance in the system.

The regenerated catalyst may exit the regenerator and be recycled back to the reactor via a catalyst recycle stream. In some cases, catalyst may be lost from the system during operation. In some cases, additional "makeup" catalyst may be added to the system via a makeup stream. The regenerated and makeup catalyst may be fed to the reactor with the fluidization fluid via a recycle stream, although in other embodiments, the catalyst and fluidization fluid may be fed to the reactor via separate streams.

The reaction products (e.g., fluid hydrocarbon products) may be fed to a solids separator where solid catalyst may be separated from the fluid products.

In some instances, the initial products of the process may be fed to a quench tower to which is fed a cooling fluid, preferably a liquid, along with the product stream to cool and condense the products. In some embodiments, the desired reaction product(s) (e.g., liquid aromatic hydrocarbons, olefin hydrocarbons, gaseous products, etc.) may be recovered at any point in the production process (e.g., after passage through the reactor, after separation, after condensation, etc.).

In some embodiments the reaction product is sent to a quench to remove heavy hydrocarbons into a quench fluid. In some cases, the quench fluid comprises liquid products recovered in subsequent separation steps. The gaseous stream from the quench can be sent to a fractionation tower where the various aromatic liquid components can be recovered. This quench and fractionation tower can be operated at elevated pressures of 1-7 bara for more efficient liquid recoveries. The gaseous stream from the top of the fractionation tower can be sent to an absorption tower where the final fraction of remaining liquid organic is recovered. This can be done using a lean oil fraction as the absorption fluid which can comprise liquid product recovered from the fractionation tower or other available liquid known to those skilled in the art. A portion of the gaseous stream, now stripped of most higher boiling products, may be sent back to the reactor for further conversion of olefins, and another portion may be sent to feed the olefins purification section.

GLOSSARY

Aromatics—As used herein, the terms "aromatics" or "aromatic compound" are used to refer to a hydrocarbon compound or compounds comprising one or more aromatic groups such as, for example, single aromatic ring systems (e.g., benzyl, phenyl, etc.) and fused polycyclic aromatic ring systems (e.g. naphthyl, 1,2,3,4-tetrahydronaphthyl, etc.). Examples of aromatic compounds include, but are not limited to, benzene, toluene, indane, indene, 2-ethyl toluene, 3-ethyl toluene, 4-ethyl toluene, trimethyl benzene (e.g., 1,3,5-trimethyl benzene, 1,2,4-trimethyl benzene, 1,2,3-trimethyl benzene, etc.), ethylbenzene, styrene, cumene, methylbenzene, propylbenzene, xylenes (e.g., p-xylene, m-xylene, o-xylene, etc.), naphthalene, methyl-naphthalene (e.g., 1-methyl naphthalene, anthracene, 9.10-dimethylanthracene, pyrene, phenanthrene, dimethyl-naphthalene (e.g., 1,5-dimethylnaphthalene, 1,6-dimethylnaphthalene, 2,5-dimethylnaphthalene, etc.), ethyl-naphthalene, hydrindene, methyl-hydrindene, and dymethyl-hydrindene. Single-ring and/or higher ring aromatics may also be produced in some embodiments.

Fluid—The term "fluid" refers to a gas, a liquid, a mixture of a gas and a liquid, or a gas or a liquid containing dispersed solids, liquid droplets and/or gaseous bubbles. The terms "gas" and "vapor" have the same meaning and are sometimes used interchangeably. In some embodiments, it may be advantageous to control the residence time of the fluidization fluid in the reactor. The fluidization residence time of the fluidization fluid is defined as the volume of the reactor divided by the volumetric flow rate of the fluidization fluid under process conditions of temperature and pressure.

Fluidized Bed Reactor—The term "fluidized bed reactor" is given its conventional meaning in the art and is used to refer to reactors comprising a vessel that can contain a granular solid material (e.g., silica particles, catalyst particles, etc.), in which a fluid (e.g., a gas or a liquid) is passed through the granular solid material at velocities sufficiently high as to suspend the solid material and cause it to behave as though it were a fluid. Examples of fluidized bed reactors are described in Kirk-Othmer Encyclopedia of Chemical Technology (online), Vol. 11, Hoboken, N.J.: Wiley-Interscience, 2001, pages 791-825, incorporated herein by reference. The term "circulating fluidized bed reactor" is also given its conventional meaning in the art and is used to refer to fluidized bed reactors in which the granular solid material is passed out of the reactor, circulated through a line in fluid communication with the reactor, and recycled back into the reactor. Examples of circulating fluidized bed reactors are described in Kirk-Othmer Encyclopedia of Chemical Technology (Online), Vol. 11, Hoboken, N.J.: Wiley-Interscience, 2001, pages 791-825.

Bubbling fluidized bed reactors and turbulent fluidized bed reactors are also known to those skilled in the art. In bubbling fluidized bed reactors, the fluid stream used to fluidize the granular solid material is operated at a sufficiently low flow rate such that bubbles and voids are observed within the volume of the fluidized bed during operation. In turbulent fluidized bed reactors, the flow rate of the fluidizing stream is higher than that employed in a bubbling fluidized bed reactor, and hence, bubbles and voids are not observed within the volume of the fluidized bed during operation. Examples of bubbling and turbulent fluidized bed reactors are described in Kirk-Othmer Encyclopedia of Chemical Technology (online), Vol. 11, Hoboken, N.J.: Wiley¬Interscience, c2001-, pages 791-825, incorporated herein by reference.

Olefins—The terms "olefin" or "olefin compound" (a.k.a. "alkenes") are given their ordinary meaning in the art, and are used to refer to any unsaturated hydrocarbon containing one or more pairs of carbon atoms linked by a double bond. Olefins include both cyclic and acyclic (aliphatic) olefins, in which the double bond is located between carbon atoms forming part of a cyclic (closed-ring) or of an open-chain grouping, respectively. In addition, olefins may include any suitable number of double bonds (e.g., monoolefins, diolefins, triolefins, etc.). Examples of olefin compounds include, but are not limited to, ethene, propene, allene (propadiene), 1-butene, 2-butene, isobutene (2 methyl propene), butadiene, and isoprene, among others. Examples of cyclic olefins include cyclopentene, cyclohexane, cycloheptene, among others. Aromatic compounds such as toluene are not considered olefins; however, olefins that include aromatic moieties are considered olefins, for example, benzyl acrylate or styrene.

Catalysts—Catalyst components useful in the context of this invention can be selected from any catalyst known in the art, or as would be understood by those skilled in the art. Catalysts promote and/or effect reactions. Thus, as used herein, catalysts lower the activation energy (increase the rate) of a chemical process, and/or improve the distribution of products or intermediates in a chemical reaction (for example, a shape selective catalyst). Examples of reactions that can be catalyzed include: dehydration, dehydrogenation, isomerization, hydrogen transfer, hydrogenation, polymerization, cyclization, desulfurization, denitrogenation, deoxygenation, aromatization, decarbonylation, decarboxylation, aldol condensation, and combinations thereof. Catalyst components can be considered acidic, neutral or basic, as would be understood by those skilled in the art.

For catalytic pyrolysis, particularly advantageous catalysts include those containing internal porosity selected according to pore size (e.g., mesoporous and pore sizes typically associated with zeolites), e.g., average pore sizes of less than about 100 Angstroms, less than about 50 Angstroms, less than about 20 Angstroms, less than about 10 Angstroms, less than about 5 Angstroms, or smaller. In some embodiments, catalysts with average pore sizes of from about 5 Angstroms to about 100 Angstroms may be used. In some embodiments, catalysts with average pore sizes of between about 5.5 Angstroms and about 6.5 Angstroms, or between about 5.9 Angstroms and about 6.3 Angstroms may be used. In some cases, catalysts with average pore sizes of between about 7 Angstroms and about 8 Angstroms, or between about 7.2 Angstroms and about 7.8 Angstroms may be used.

In some preferred embodiments of catalytic pyrolysis, the catalyst may be selected from naturally occurring zeolites, synthetic zeolites and combinations thereof. In certain embodiments, the catalyst may be a ZSM-5 zeolite catalyst, as would be understood by those skilled in the art. Optionally, such a catalyst can comprise acidic sites. Other types of zeolite catalysts include: ferrierite, zeolite Y, zeolite beta, mordenite, MCM-22, ZSM-23, ZSM-57, SUZ-4, EU-1, ZSM-11, (S)AlPO-31, SSZ-23, among others. Zeolites and other small pore materials are often characterized by their Constraint Index.

A simple determination of the Constraint Index may be made by passing continuously a mixture of an equal weight of normal hexane and 3-methylpentane over a small sample, approximately 1 gram or less, of crystalline material at atmospheric pressure according to the following procedure. The sample of the crystalline material, in the form of pellets or extrudate, is crushed to a particle size about that of coarse sand and mounted in a glass tube. Prior to testing, the crystalline material is treated with a stream of air at 537° C. for at least 15 minutes. The crystalline material is then flushed with helium and the temperature adjusted between 287° C. and 510° C. or higher to allow an overall conversion of between 10% and 60% when the mixture of hydrocarbons is passed at 1 liquid hourly space velocity (i.e., 1 volume of liquid hydrocarbon per volume of crystalline material per hour) over the crystalline material with a helium dilution to give a helium to total hydrocarbon mole ratio of 4:1. After 20 minutes on stream, a sample of the effluent is analyzed, most conveniently by gas chromatography, to determine the fraction remaining unchanged for each of the two hydrocarbons. The Constraint Index is the ratio of the log of the n-hexane remaining divided by the log of the 3-methylpentane remaining. The Constraint Index approximates the ratio of the cracking rate constants for the two hydrocarbons. The method by which Constraint Index is determined is described more fully in U.S. Pat. No. 4,029,716, incorporated by reference for details of the method.

Constraint Index (CI) values for some typical materials are:

TABLE 1

Constraint Indices of some common zeolites.

| Material | Constraint Index | Test Temp, ° C. |
|---|---|---|
| ZSM-4 | 0.5 | 316 |
| ZSM-5 | 6-8.3 | 371-316 |
| ZSM-11 | 5-8.7 | 371-316 |
| ZSM-12 | 2.3 | 316 |
| ZSM-20 | 0.5 | 371 |
| ZSM-22 | 7.3 | 427 |
| ZSM-23 | 9.1 | 427 |
| ZSM-34 | 50 | 371 |
| ZSM-35 | 4.5 | 454 |
| ZSM-48 | 3.5 | 538 |
| ZSM-50 | 2.1 | 427 |
| Mordenite | 0.5 | 316 |

TABLE 1-continued

Constraint Indices of some common zeolites.

| Material | Constraint Index | Test Temp, ° C. |
|---|---|---|
| REY | 0.4 | 316 |
| Dealuminized Y | 0.5 | 510 |
| Beta | 0.6-2 | 316-399 |

CI values typically characterize the specified crystalline material, but are the cumulative result of several variables useful in the determination and calculation thereof. Thus, for a given crystal exhibiting a CI value within the range of 1 to 12, depending on the temperature employed during the test method, with accompanying conversion between 10 and 60%, the CI may vary within the indicated range of 1 to 12. Likewise, other variables such as crystal size or the presence of possibly occluded contaminants and binders intimately combined with the crystal may affect the CI. It is understood to those skilled in the art that the CI, as utilized herein, while affording a highly useful means for characterizing the molecular sieves of interest is approximate, taking into consideration the manner of its determination, with the possibility, in some instances, of compounding variable extremes. However, in all instances, at a temperature within the above-specified range, the CI will have a value for any given molecular sieve useful herein within the approximate range of 1 to 12.

In other embodiments, non-zeolite catalysts may be used; for example, WOx/ZrO2, aluminum phosphates, etc. In some embodiments, the catalyst may comprise a metal and/or a metal oxide. Suitable metals and/or oxides include, for example, nickel, palladium, platinum, titanium, vanadium, chromium, manganese, iron, cobalt, zinc, copper, gallium, and/or any of their oxides, among others. In some cases promoter elements chosen from among the rare earth elements, i.e., elements 57-71, cerium, zirconium or their oxides for combinations of these may be included to modify activity or structure of the catalyst. In addition, in some cases, properties of the catalysts (e.g., pore structure, type and/or number of acid sites, etc.) may be chosen to selectively produce a desired product.

Catalysts for other processes, such as alkylation of olefins, hydrogenation, hydrotreating, deoxygenation, denitrogenation, and desulfurization are well-known and can be selected for the olefin conversion or other processes described herein.

Low and High Coke-Forming Materials

Materials can be classified as high coke-forming or low coke-forming by conducting a simple experiment as described in the Examples using a drop-tube reactor and ZSM-5 catalyst at either 500° C. for plastics or similar materials and 525° C. for biomass or similar materials. Low coke-forming materials are those which, when catalytically pyrolyzed in the presence of ZSM-5 according to the method described in the Examples, produce less than 5% by mass of solid coke and char in the product mixture. High coke-forming materials are those which, when catalytically pyrolyzed in the presence of ZSM-5 according to the method described in the Examples, produce greater than 10% by mass of solid coke and char in the product mixture. Materials that produce intermediate yields of coke and char, i.e. from 5% to 10% by mass, when catalytically pyrolyzed in the presence of ZSM-5 according to the method described in the Examples, can be considered either low coke-forming or high coke-forming materials, depending on the other components of the mixture. In some embodiments of the invention, materials that produce from 5% to 10% coke and char may be mixed with low coke-forming material(s) in order to increase the coke produced such that the coke, or coke and a portion of the byproduct gases combustion provides the energy required in the process. In other instances, materials that produce from 5% to 10% coke and char may be mixed with high coke-forming material(s) in appropriate proportions such that combustion of the coke or coke and a portion of the byproduct gases produced provides the energy required in the process.

Plastics or Polymers—The terms "plastics" and "polymers" are used interchangeably herein. A polymer is a carbon-based (at least 50 mass % C) material chiefly made up of repeating units and having a number average molecular weight of at least 100, typically greater than 1000 or greater than 10,000.

Pyrolysis—The terms "pyrolysis" and "pyrolyzing" are given their conventional meaning in the art and are used to refer to the transformation of a compound, e.g., a solid hydrocarbonaceous material, into one or more other substances, e.g., volatile organic compounds, gases and coke, by heat, preferably without the addition of, or in the absence of, $O_2$. Preferably, the volume fraction of $O_2$ present in a pyrolysis reaction chamber is 0.5% or less. Pyrolysis may take place with or without the use of a catalyst. "Catalytic pyrolysis" refers to pyrolysis performed in the presence of a catalyst, and may involve steps as described in more detail below. Example of catalytic pyrolysis processes are outlined, for example, in Huber, G. W. et al, "Synthesis of Transportation Fuels from Biomass: Chemistry, Catalysts, and Engineering," Chem. Rev. 106, (2006), pp. 4044-4098.

Selectivity—The term "selectivity" refers to the amount of production of a particular product in comparison to a selection of products. Selectivity to a product may be calculated by dividing the amount of the particular product by the amount of a number of products produced. For example, if 75 grams of aromatics are produced in a reaction and 20 grams of benzene are found in these aromatics, the selectivity to benzene amongst aromatic products is 20/75=26.7%. Selectivity can be calculated on a mass basis, as in the aforementioned example, or it can be calculated on a carbon basis, where the selectivity is calculated by dividing the amount of carbon that is found in a particular product by the amount of carbon that is found in a selection of products. Unless specified otherwise, for reactions involving polymers as reactants, selectivity is on a mass basis. For reactions involving conversion of a specific molecular reactant (ethene, for example), selectivity is the percentage (on a mass basis unless specified otherwise) of a selected product divided by all the products produced.

Yield—The term yield is used herein to refer to the amount of a product flowing out of a reactor divided by the amount of reactant flowing into the reactor, usually expressed as a percentage or fraction. Yields are often calculated on a mass basis, carbon basis, or on the basis of a particular feed component. Mass yield is the mass of a particular product divided by the weight of feed used to prepare that product. For example, if 500 grams of polymer is fed to a reactor and 45 grams of benzene is produced, the mass yield of benzene would be 45/500=9% benzene. Carbon yield is the mass of carbon found in a particular product divided by the mass of carbon in the feed to the reactor. For example, if 500 grams of polymer that contains 90% carbon is reacted to produce 400 grams of benzene that contains 92.3% carbon, the carbon yield is [(400*0.923)/(500*0.90)] =82.0%.

As is standard patent terminology, the term "comprising" means "including" and does not exclude additional components. Any of the inventive aspects described in conjunction with the term "comprising" also include narrower embodiments in which the term "comprising" is replaced by the narrower terms "consisting essentially of" or "consisting of." As used in this specification, the terms "includes" or "including" should not be read as limiting the invention but, rather, listing exemplary components.

DESCRIPTION OF SOME PREFERRED EMBODIMENTS

The various features, characteristics, embodiments, etc. that are described herein are not limited to a single aspect or embodiment and should be understood as applicable to any of the inventive aspects described herein.

In an embodiment of the invention, polymers or plastics or polymers and plastics are fed to a catalytic pyrolysis reactor to form a gaseous product containing aromatic compounds and olefins, wherein the olefins are separated from the product, the olefins are purified and separated into the various component olefins, and each olefin stream is sent for further processing for conversion to useful products. Since olefins are commonly produced, the invention is generally applicable to any polymer pyrolysis reaction. Preferably, the polymer feedstock comprises a solid material. The pyrolysis reactor comprises a solid catalyst for fast catalytic pyrolysis. The type of reactor and the type of solid catalyst (if present) are not limited, and can be generally of the type known for conversion of polymeric materials to fluid hydrocarbonaceous streams. Conditions for catalytic pyrolysis of polymers can be selected from any one or any combination of the following features (which are not intended to limit the broader aspects of the invention): a zeolite catalyst, a ZSM-5 catalyst; a microporous catalyst with constraint index between 1 and 12; a zeolite catalyst comprising one or more of the following metals: titanium, vanadium, chromium, manganese, iron, cobalt, nickel, copper, zinc, gallium, platinum, palladium, silver, phosphorus, sodium, potassium, magnesium, calcium, tungsten, zirconium, cerium, lanthanum, and combinations thereof; a fluidized bed, circulating bed, bubbling bed, or riser reactor; an operating temperature in the range from 300° C. to 1000° C., or from 400° C. to 650° C., or from 450° C. to 600° C., or from 500° C. to 575° C.; a solid catalyst-to-polymer feed mass ratio of between 0.1 and 20 or between 0.5 and 15, or between 1 and 10, or between 3 and 8; the space velocity is in the range from 0.1 to 10 or from 0.2 to 8, or from 0.5 to 5, or from 1 to 4; the pressure is from 1 bara (actual bar) to 30 bara, or from 2 bara to 15 bara, or from 3 bara to 10 bara, or from 4 to 7 bara, or at least 3 bara, or at least 4 bara, or at least 6 bara; or a feed residence time from 0.1 to 120 seconds, or from 1 to 60 seconds, or from 5 to 30 seconds, or from 8 to 20 seconds, or less than 60 seconds, or less than 30 seconds, or less than 10 seconds, or less than 8 seconds, where feed residence time is calculated as the average time a carbon atom spends in the reactor at a temperature of at least 400° C. under actual conditions of temperature and pressure.

The pyrolysis process is normally conducted in an atmosphere with very low or zero oxygen (O2) concentration, usually less than 0.5% by volume. Nevertheless, in some embodiments the pyrolysis process can be conducted with concentrations of O2 of 0.6% by volume or greater in order to rapidly increase the temperature of the mixture to the desired reaction temperature, or to overcome the endothermic nature of the process, or both. In some embodiments the process feed is introduced at temperatures from 100° C. to 450° C., and the temperature can be very rapidly increased (changed) by at least 25° C., or at least 100° C., or at least 200° C., or at least 300° C., or from 100° C. to 400° C. by the use of small concentrations of $O_2$ in the process. The introduction of oxygen initiates combustion of hydrocarbons, CO, H2, or other components, or some combination, in the process to supply the needed thermal energy to achieve conversion of the feed materials. In these cases the concentration of $O_2$ in the feed to the reactor resulting from this addition could be from 0.6% to 10%, 0.6% to 8%, 1% to 6%, or from 2% to 4% by weight, or at least 0.6%, at least 2%, at least 4%, or at least 6% by weight, where the percent weight of $O_2$ is in comparison to the weight of the polymer feed mixture, but in all cases the oxygen concentration introduced is kept below the concentration where significant unconverted oxygen may be found in the product mixture exiting the reactor. The oxygen is preferably introduced by the addition of air or $O_2$ as a component of the fluidization fluid, or with the gas injected with the plastics, or by separate, direct injection into the fluidized bed, or some combination thereof.

Feed materials for the process comprise one or more of the following materials: polyethylene, polypropylene, polyacetylene, polybutylene, polyolefins, polyethylene terephthalate (PET), polybutyleneterephthalate, copolyesters, polyester, polycarbonate, polyurethanes, polyamides, polystyrene, polyacetal, epoxies, polycyanurates, polyacrylics, polyurea, vinyl esters, polyacrylonitrile, polyvinyl alcohol, polyvinylchloride (PVC), polyvinyl acetate, nylon, copolymers such as: ethylene-propylene, EPDM, acrylonitrile-butadiene-styrene (ABS), nitrile rubber, natural and synthetic rubber, tires, styrene-butadiene, styrene-acrylonitrile, styrene-isoprene, styrene-maleic anhydride, ethylene-vinylacetate, nylon 12/6/66, filled polymers, polymer composites, plastic alloys, and polymers or plastics dissolved in a solvent. The feed materials can comprise materials obtained from polymer or plastic manufacturing processes as waste or discarded materials, post-consumer recycled polymer materials, materials separated from waste streams such as municipal solid waste, black liquor, or wood waste. In some embodiments, the feed stream contains at least 80 or at least 90 or at least 95 mass percent of polyethylene or polypropylene, or a combination of both. In some embodiments, the feed stream contains at least 80 or at least 90 or at least 95 mass percent of PET or polyester, or a combination of both. In some embodiments, the process is surprisingly resistant to impurities such as halogens, that would be more destructive in conventional processes.

The molecular sieve for use herein or the catalyst composition comprising same may be thermally treated at high temperatures. This thermal treatment is generally performed by heating at a temperature of at least 370° C. for a least 1 minute and generally not longer than 20 hours (typically in an oxygen containing atmosphere, preferably air). While subatmospheric pressure can be employed for the thermal treatment, atmospheric pressure is desired for reasons of convenience. The thermal treatment can be performed at a temperature up to 925° C. The thermally treated product is particularly useful in the present process.

For the catalyst composition useful in this invention, the suitable molecular sieve may be employed in combination with a support or binder material such as, for example, a porous inorganic oxide support or a clay binder. Non-limiting examples of such binder materials include alumina, zirconia, silica, magnesia, thoria, titania, boria and combinations thereof, generally in the form of dried inorganic oxide gels and gelatinous precipitates. Suitable clay materials include, by way of example, bentonite, kieselguhr and combinations thereof. The relative proportion of suitable crystalline molecular sieve of the total catalyst composition may vary widely with the molecular sieve content ranging from 30 to 90 percent by weight and more usually in the range of 40 to 70 percent by weight of the composition. The catalyst composition may be in the form of an extrudate, beads or fluidizable microspheres.

The molecular sieve for use herein or the catalyst composition comprising it may have original cations replaced, in accordance with techniques well known in the art, at least in part, by ion exchange with hydrogen or hydrogen precursor cations and/or non-noble metal ions of Group VIII of the Periodic Table, i.e. nickel, iron and/or cobalt.

In broader aspects of the invention, the olefin-containing product stream can have a wide variety of compositions. The fraction could simply be the gaseous (noncondensed) fraction that includes CO, CO2, ethylene, propylene, and numerous other components and may include higher olefins. The olefin-containing product could also contain alkynes such as ethyne, propyne, butyne or the like. In other embodiments, the fraction could be a relatively olefin-rich stream that is separated from a relatively olefin-poor stream. Examples of separation techniques that can be used in a polymer conversion system include: cryogenic separation, distillation, membrane separation, adsorptive separation, or reactive separation. In some preferred embodiments, the olefin-containing product comprises at least 20 mass % olefins, in some embodiments, at least 50 mass % olefins, and in some embodiments, in the range of 20 to 90 mass % olefins or more. Other gases in the olefin-containing fraction could include methane, ethane, propane, CO, CO2, water, propadiene, methyl acetylene, H2, or N2, or some combination thereof.

The olefin product stream from the catalytic pyrolysis (the raw feed from the pyrolysis, prior to purification) can comprise C2-C4 alkenes including: ethylene, propylene, butylene, butadienes. The olefin content can be in the range of 1-70 wt %, or 5-65 wt %, or 10-60 wt %, or 20-50 wt %, or 30-45 wt %, or 40-65 wt %, or 50-70 wt %, or at least 20 wt %, or at least 30 wt %, or at least 40 wt %, or at least 50 wt %, or at least 60 wt %. The mass ratio of ethylene to propylene can vary from 0.2 to 3 depending on reaction conditions and feedstock. The mass ratio of butenes to propylene can vary between 0.05 and 0.25. Other minor components such as C5-C7 olefins are present in much smaller mass ratios to propylene, generally less than 0.1. In some embodiments the mass yield of olefins is at least 30%, or at least 40%, or at least 45%, or at least 50%, or at least 55%, or at least 60%, or from 20% to 70%, or from 30% to 65%, or from 45% to 60%, based on the mass in the polymer or plastic feed. In some embodiments the mass yield of BTX is at least 10%, or at least 20%, or at least 30%, or at least 40% or at least 50%, or from 3% to 60%, or from 5% to 50%, or from 10% to 50%, or from 20 to 50%, based on the mass of the plastic or polymer feed to the process. In some embodiments, the mass yield of coke and char is less than 10%, or less than 5%, or less than 2%, or less than 1%, or less than 0.5%, or from 0.1% to 10%, or from 0.2% to 5%, or from 0.3 to 2%, based on the mass in the polymer or plastic fed. In some embodiments, the mass yield of olefins plus aromatics is greater than 60%, or greater than 70% or greater than 80%, or greater than 85%, or greater than 90%, or from 70% to 99%, or from 80% to 98%, or from 85% to 95%, or from 90% to 93%, based on the mass in the polymer or plastic fed. In some embodiments, the selectivity of ethylene as a percentage of the total olefins produced is at least 20%, or at least 25%, or at least 30%, or from 10% to 40%, or from 20% to 35%, or from 25% to 30%. In some embodiments the selectivity of propylene as a percentage of the total olefins produced is at least 20%, or at least 30%, or at least 40%, or at least 45%, or at least 50%, or from 20% to 70%, or from 30% to 65%, or from 45% to 55%. In some embodiments the selectivity of benzene plus toluene plus xylenes as a percentage of aromatics produced is at least 70%, or at least 80%, or at least 90%, or at least 95%, or at least 97%, or from 70% to 99.9%, or from 80% to 99.5%, or from 90 to 99%, or from 95% to 98%.

Olefin mixtures produced by the inventive process can be separated and purified by conventional cryogenic distillation, membrane separation, hybrid membrane distillation, selective adsorption, or facilitated transport systems as are known in the art. Impurities such as CO2, HCl, HCN, or H2S can be removed by amine scrubbing or caustic scrubbing or other conventional means known to those skilled in the art. Removal of impurities can be optionally performed before or after the separation of the olefins from the other vapor components.

Aromatics mixtures produced by the inventive process can be separated and purified by conventional distillation, membrane separation, hybrid membrane distillation, selective adsorption, or facilitated transport systems as are known in the art. Impurities such as phenols, thiols, thiophenes, nitriles, amines, or other oxygen, sulfur, or nitrogen containing impurities can be removed by hydrotreating or other conventional means known to those skilled in the art. Removal of impurities can be optionally performed before or after the separation of the aromatics from the other condensable components.

In some embodiments, downstream conversion of the olefin-containing stream occurs in a catalyst-containing reactor such as a packed bed reactor. Conversion reactions can include (but are not limited to) one or more of the following reactions: hydrogenation, hydrolysis, hydroformylation, cyclization, dimerization, and/or polymerization. The conversion process can be conducted at lower temperatures than the pyrolysis process in a secondary reactor or in a zone of the pyrolysis reactor that is at lower temperatures; temperatures during olefin conversion are preferably maintained below 400° C., and are preferably in the range 80° C.-400° C.

In some embodiments, the olefin-containing product stream is contacted with an acid catalyst at conditions to cause dimerization or oligomerization. Acid catalysts can be chosen from among those known to those skilled in the art, including liquid acids like: H2SO4 or HNO3, supported acids such as sulfated zirconia, or solid acids such as solid phosphoric acid, zeolites, pillared clays, or amorphous silica-alumina mixtures. Preferred catalysts comprise solid phosphoric acid (such as phosphoric acid on kieselguhr) or zeolites ZSM5, ZSM11, ZSM12, ZSM22, ZSM23, ZSM35, ZSM49, and MCM56. Regenerated catalyst can be used, including regenerated ZSM5 from the pyrolysis process. A preferred temperature range is 120° C. to 300° C., more preferably 150° C. to 250° C.; although higher temperatures could be used. Pressures preferably are in the range of 1 atm to 20 atm (100 kPa to 2,000 kPa), more preferably 1-5 atm (100 kPa to 500 kPa). Higher pressures can be used if high conversion of the olefins is desired. Space velocity for the dimerization/oligomerization is preferably in the range of 5 to 30 GHSV (gas hourly space velocity, the ratio of gas volumetric flow to reactor volume). The reaction can be conducted in various types of reactors, but preferably is conducted in a fixed-bed reactor. This reaction is most effective for the conversion of C3 and higher; thus, for a mixture comprising ethylene and propylene, typically more of the propylene is consumed.

In one downstream conversion process, the olefins are converted by alkylation of aromatics. In this case, the olefin-containing stream is preferably mixed with an aromatic-containing stream and contacted with an acid catalyst. Acid catalysts can be chosen from among those known to those skilled in the art including liquid acids like H2SO4 or HNO3, supported acids, such as sulfated zirconia, or solid acids such as solid phosphoric acid, zeolites, pillared clays, or amorphous silica-alumina mixtures.

Preferred catalysts include: zeolite Y, such as ultrastable zeolite Y (USY), or zeolites ZSM5, ZSM11, ZSM12, ZSM22, ZSM23, ZSM35, and ZSM49. The zeolite catalyst is typically present along with a binder such as silica, alumina, or zirconia, or mixtures thereof. The catalysts can be promoted with metals to improve performance and limit coke deposition. Any metal from those of atomic numbers 21-31, 57-71 and the precious metals Pd, Pt, Ag or Au can be used, or combinations thereof, more preferably the catalyst comprises Pd, Pt, or combinations thereof. Combinations of Pt and/or Pd with Ru, Ir, Rh, Cu, Re, Ag and/or Au are also desirable. More preferably, in addition to Pt and/or Pd, the catalyst comprises Ni, Co, Mn, Cr, V, Fe, Ti, or combinations thereof. Preferably, the catalyst contains 0.1 to 2 mass percent of the above-mentioned metals. Regenerated catalyst can be used, including regenerated ZSM5 or other catalyst from the catalytic pyrolysis process. A preferred temperature range is 120° C. to 300° C., more preferably 150° C. to 250° C.; although higher temperatures could be used. Pressures preferably are in the range from 1 atm to 20 atm (100 kPa to 2,000 kPa), with pressures of 1-5 atm (100 kPa to 500 kPa) more preferred. Higher pressures can be used if high conversion of the olefins is desired. In some preferred embodiments, the olefin-containing product stream is contacted with a liquid, aromatic-containing stream that extracts olefins from the olefin-containing stream; then the alkylation of olefins in the aromatic-containing stream is conducted simultaneously with or, more preferably, subsequent to the extraction step. Preferably, at least a portion, and more preferably all of the aromatic compounds used in the alkylation process are derived from the product stream of a catalytic pyrolysis reactor. The molar ratio of aromatic compounds to olefins is preferably greater than 1, more preferably greater than 5. The alkylation reaction may be conducted in a variety of reactor types, preferably a fixed-bed reactor, and in some embodiments, the olefins are fed at multiple points along the length of a fixed-bed reactor.

In some embodiments, the olefin-containing product stream is subjected to both dimerization/oligomerization and alkylation. These processes could be conducted in series (in either order). Alternatively, the olefin-containing stream could be split and separate fractions treated with dimerization/oligomerization and alkylation. In another embodiment the olefin product stream is mixed with water vapor and passed over a hydrolysis catalyst effective for the hydrolysis of olefins at a lower temperature to product alcohols. The hydrolysis catalyst is a catalyst that catalyzes reactions between water and olefins to form alcohols, such as an acidic catalyst. Acid catalysts can be chosen from among those known to those skilled in the art including supported acids such as sulfated zirconia, sulfated silica, or sulfated alumina, or solid acids such as solid phosphoric acid, zeolites, pillared clays, or amorphous silica-alumina mixtures. Preferred catalysts are sulfated silica, sulfated alumina, sulfated zirconia, solid phosphoric acid, or acid-treated clays. Temperatures are preferably between 170° C. and 400° C., more preferably 220° C. to 300° C. in the zone holding the catalyst.

In another embodiment, the olefin-containing product stream is mixed with methanol (typically in the vapor phase) and passed over a catalyst to form an ether. Temperatures in the ether-forming stage are preferably between 200° C. and 400° C. in the zone holding the catalyst. The catalyst is a catalyst that catalyzes reactions between alcohols and olefins to form ethers, such as an acidic catalyst, preferably a solid acid catalyst. Acid catalysts can be chosen from among those known to those skilled in the art including supported acids such as sulfated zirconia, sulfated silica, or sulfated alumina, or solid acids such as solid phosphoric acid, zeolites, pillared clays, or amorphous silica-alumina mixtures. Preferred catalysts are sulfated silica, sulfated alumina, sulfated zirconia, solid phosphoric acid, or acid-treated clays. Ion exchange resins in which an acidic group such as sulfate, nitrate, phosphate, carboxylate, benzoate, or trifluoroacetate is attached to a polymeric backbone, such as Amberlyst, can also be used. Temperatures are preferably between 170° C. and 400° C., more preferably 220° C. to 300° C. in the zone holding the catalyst. Pressure for the reaction is preferably at least 1 atm (100 kPa), and in some embodiments in the pressure range of 1 to 50 atm (100 to 5,000 kPa). The molar ratio of alcohol-to-olefin is preferably in the range of 0.1 to 10, more preferably 0.5 to 5, and in some embodiments 0.5 to 2. The olefins can also be reacted with higher alcohols, such as ethanol, propanol (n-propanol, iso-propanol, or mixtures thereof) or mixtures of alcohols, to form ethers. This reaction can be conducted in the presence of catalysts and under the conditions mentioned above with respect to methanol. A more preferred temperature range is 100° C. to 200° C. In addition, or as an alternative to the catalysts mentioned above for methanol, zeolite catalysts can be present in the reactor in which ethers are produced. Examples of suitable zeolites include: zeolite Y, zeolite X, ZSM-3, ZSM-5, ZSM-12, ZSM-20, ZSM-23, ZSM-35, ZSM-38, ZSM-50, MCM-22, and mixtures thereof.

In any of the processes described herein, the olefin-containing gas can be partially separated into different fractions for functionalization to remove non-reactive components or to purge excess materials.

In another embodiment of the invention an aromatic stream recovered from the process can be separated and hydrogenated to produce fuel blendstocks as described in WO2017136177 and WO2017136178, "Chemicals and Fuel Blendstocks by a Catalytic Fast Pyrolysis Process" incorporated herein by reference.

Integration with Steam Cracking

'When polyolefins are used as feedstock to Plas-TCat a high yield of ethylene and propylene is produced along with C4+ hydrocarbons including BTX. A Plas-TCat process facility can be located adjacent to a petroleum feedstock-based primary olefin production enterprise based on steam cracking technology. When both processes are co-located, they can share a common downstream separation facility for higher efficiency and reduced operating and capital costs. Recovery and purification of light olefins from light paraffins and other hydrocarbons requires a complex series of distillation towers, cryogenic processing, and clean-up reactors which creates high capital and operating costs. For this and other reasons, steam cracking facilities are generally the largest petrochemical units in existence to take advantage of economy of scale for lower unit production costs.

Co-location of a plastics catalytic pyrolysis (Plas-TCat) process with a steam cracking facility provides several advantages, among these are (1) single unit operation, (2) purge gas combustion can provide enough heat to the catalyst to conduct the endothermic pyrolysis reaction, (3) improved heat integration, (4) control of the temperature of the regenerator by the amount of purge gas in the regenerator feed, (5) reduced costs due to shared infrastructure such as product separation, gas compression, product quench, (6) flexible unit operation, (7) recycled olefins or other gaseous products can provide the fluidization gas required for a Fluid Catalytic Cracker (FCC) unit or the Plas-TCat unit, (8) increased aromatic yield, and (9) more efficient olefin utilization.

Due to the economics of waste plastic collection, quantities of suitable feed material, and logistics of collection and transportation, it is likely that the amount of light olefins from Plas-TCat will be much less than the amount produced from a typical modern steam cracking unit, thereby making the Plas-TCat unit disadvantaged from a downstream economy of scale perspective when it is operated in isolation. Integrating Plas-TCat with a steam cracker improves the economics in a surprising way. For steam crackers that make pygas (pyrolysis gas), the pygas separation and hydrotreater can provided integrated service for both steam cracker pygas and Plas-TCat C5+ BTX-rich liquid products.

In one embodiment of the inventive process the process of polymer or plastic catalytic pyrolysis is integrated with a steam cracking facility wherein the initial product stream, or a portion thereof, is combined with a process stream of the steam cracker for purification and upgrading in the steam cracking facility.

In one embodiment, waste heat from steam cracker vapor products can be used to provide heat to the catalytic pyrolysis reactor. Heat transferred from the hot steam cracker vapors to the Plas-TCat catalyst will also contribute to quenching of the steam cracker effluent which helps avoid undesirable post-cracking reactions and increases product yield in the Plas-TCat process. The amount of light olefins that plastic waste recycling provides can be readily measured using flow meters and chemical analysis instruments, and therefore mixtures of virgin and recycled olefin can be precisely quantified. Precise quantification of the waste recycling products can provide additional income in the form of credits or subsidies for waste recycling.

Hydrogen produced by both steam cracking and Plas-TCat can be used for pygas hydrogenation, hydrotreating, other liquid product upgrading processes, or other processes. In some embodiments of the inventive process hydrogen from steam cracking, or hydrogen from catalytic pyrolysis, or some combination thereof is used for hydrocracking of heavy materials, or hydrotreating of product streams, or other processes within the facility.

Figure 6:
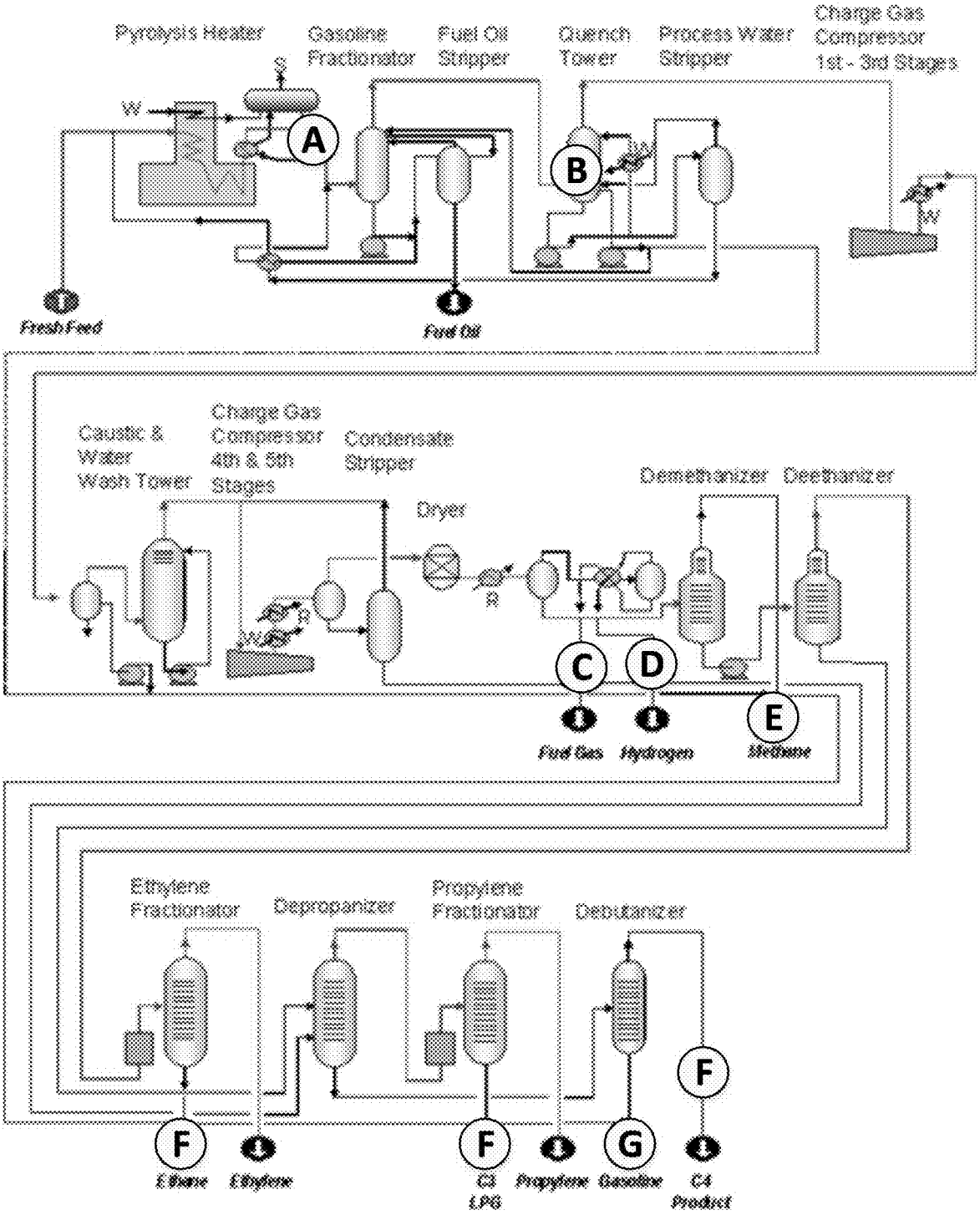
FIG. 6 is a simplified, generic process flow diagram for a steam cracker reactor and downstream product recovery and separation sequence.

FIG. 6 illustrates a simplified and generic process flow diagram for a steam cracker reactor and downstream product recovery and separation sequence, published on the internet by Toyo Engineering. The circles identified by letters of the alphabet indicate specific streams and/or locations within the process sequence where integration between Plas-TCat and steam cracker process can occur as described below.

Location "A" is the primary quench heat exchanger for the steam cracker. This is a potential location where a catalyst heater could be included. In this embodiment of the invention, catalyst circulating in the Plas-TCat unit is heated by steam cracker product gas and then used to drive the catalytic pyrolysis process. At the same time, steam cracker hot gases are partially quenched.

Location "B" is the steam cracker quench tower. Depending on steam cracker feedstock design, it may be a direct water-cooled quench, or a hot-oil quench, or a combination of hot-oil and water quench, usually as two separate towers in series. In this embodiment of the invention, hot Plas-TCat vapor products are introduced into the quench tower along with steam cracker gas and vapor products as the two streams are chemically similar. The Plas-TCat gases are generally cooler than steam cracker gases, thereby providing some additional heat integration into the configuration.

Locations "C" and "E" are streams containing methane. In one embodiment of the invention either of both streams comprising methane are used as a component of the fluidization gas in the Plas-TCat reactor.

Location "D" is hydrogen which is a by-product of both steam cracking and Plas-TCat. In one embodiment of the invention, hydrogen produced in the steam cracking is used in several locations in the inventive process including acetylene hydrogenation, methyl acetylene/propadiene hydrogenation, and pygas or other product hydrotreating to reduce sulfur, nitrogen, oxygen, triene, diene, and styrene contents thereof.

Location "F" is shown for three streams including relatively pure streams of ethane and propane and a third stream consisting of C4 olefins and paraffins. All of these components are produced by steam cracking and Plas-TCat processes. In another embodiment of the invention, either stream or any combination of them is recycled to the steam cracker to produce more ethylene and propylene. Optionally a portion of any stream could be used for Plas-TCat fluidization gas. Recycling the C4-rich stream to Plas-TCat is expected to produce more BTX and light olefin.

Finally, location "G" is a combined pygas and Plas-TCat BTX-rich naphtha. In another embodiment of the invention the combined pygas and Plas-TCat BTX rich naphtha is hydrotreated to improve its storage stability by reducing or eliminating the concentration of highly unsaturated compounds such as dienes, trienes, acetylenes, and vinyl aromatics (e.g. styrene). Trace heteroatoms such as sulfur, nitrogen, chloride, and oxygen may be removed by hydrotreating as well. In some embodiments the hydrotreated products are further separated and purified to make polymer-grade benzene, toluene, p-xylene, or some combination of these. The hydrotreating is required to reduce olefins and other contaminates to low levels suitable for polymer production or other upgrading processes.

EXAMPLES

Figure 7:
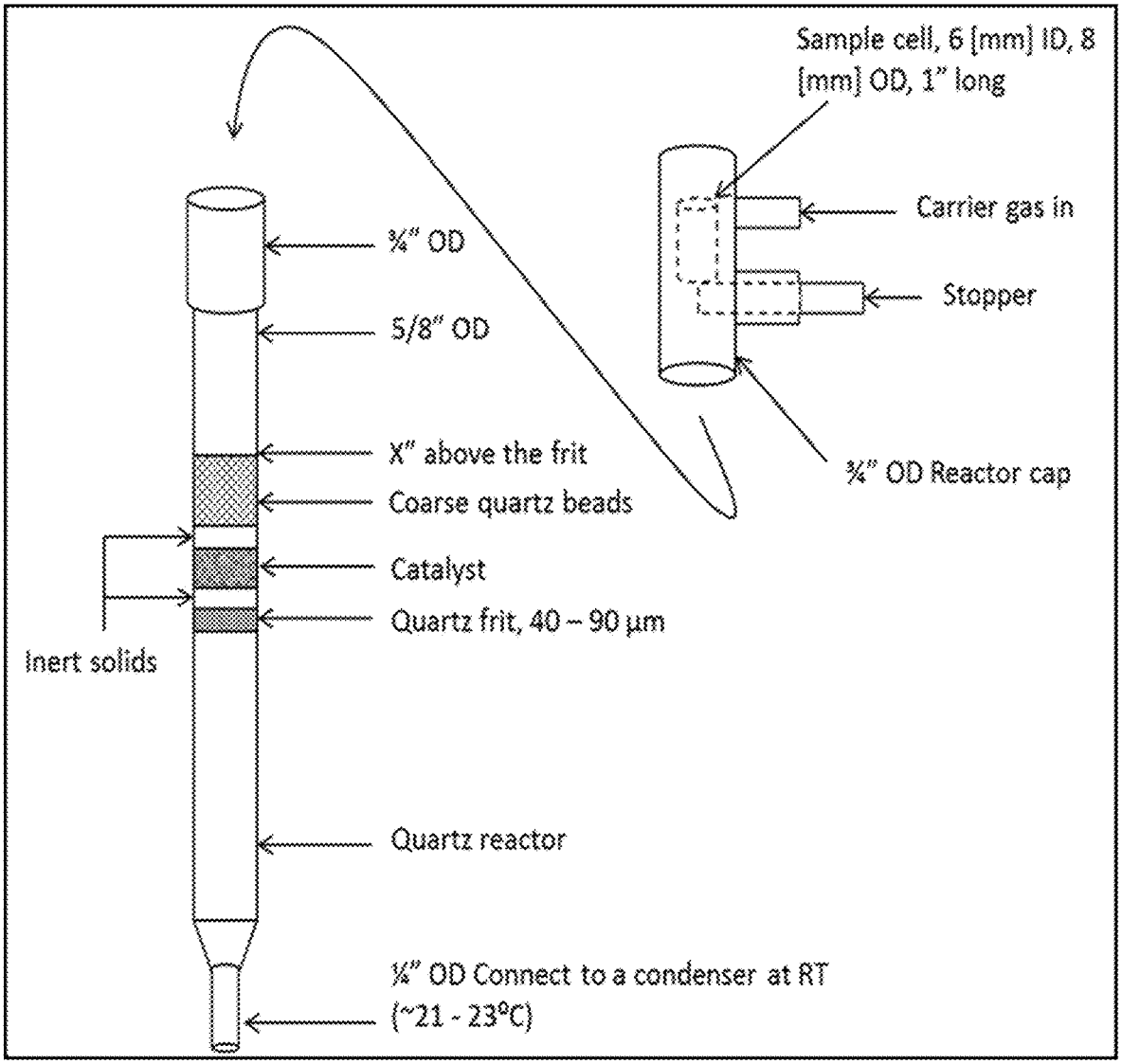
FIG. 7 is a schematic of the drop tube reactor.

The drop-tube reactor comprises a quartz reactor tube (ACE Glass) containing a quartz frit (40-90 μm) fused into the center of the tube. FIG. 7 shows the configuration of the drop-tube reactor. A sample cell (10 mm OD, 8 mm ID, 25 mm length, quartz, made by TGP) is used to contain the feedstock using two pieces of quartz wool (TGP). As illustrated in FIG. 7, the sample cell was placed in a reactor cap (borosilicate, ACE Glass) and was held by a stopper (¼ inch (6 mm) aluminum rod, McMaster). The reactor cap and the quartz reactor were then assembled and installed onto the fixed-bed reactor system. The bottom of the reactor was connected to a condenser (borosilicate) filled with perforated stainless steel packing (ACE Glass) immersed in an ice-water bath (0° C.). A heating mantle was applied between the reactor bottom and the condenser top to prevent any condensation before the condenser. During the reaction, the heating mantle was set at 210° C. In the reactor, a small sample of ZSM-5 catalyst (1.5 g) was placed on top of the quartz frit. Feedstock (100 mg for each run) was sealed in a sample cell with the quartz wool. The catalyst/feedstock weight ratio was about 15. Prior to dropping the contents of the sample cell into the reactor, the catalyst was calcined at 550° C. under 100 mL/min air flow for 20 min (ramping rate=12° C./min). After calcination, the reactor was cooled to reaction temperature (500° C. for plastics and 525° C. for biomass). During the cool-down, the condenser was filled with 10 mL of solvent (ethyl acetate for plastics conversion, and acetone for biomass conversion) and held for 10 min for temperature lineout. The reactor system was then purged with helium flow at 75 mL/min for 20 min to remove air and to purge the gas collection lines. The sample cell was dropped into the reactor by pulling out the stopper rod to initiate the reaction.

A hold period of 10 min allowed the reaction to complete. Gas products, consisting mostly of permanent gases and $C_1$-$C_3$ olefins and paraffins were collected in a gas bag. Liquid products (mostly $C_{4+}$) were collected in the condenser. After reaction the temperature was increased to 650° C. without gas flow. Solid products, including coke and char remaining in the reactor, were then burned at 650° C. for 10 min under 50 mL/min air flow. The gas products during burning were collected in a second gas bag. An additional 3 mL of solvent was added to the condenser to extract any products remaining on the top of the condenser. All of the liquid in the condenser was then transferred to a 20 mL sample vial. A weighed amount of internal standard (dioxane, typically 3000-5000 mg, Sigma-Aldrich) was added to the sample vial. The condenser was washed with acetone and was dried in a drying oven. It is noted that a small amount of liquid was retained in the condenser due to holdup on the packing. Therefore, the weight of the condenser with and without liquid products was measured to obtain the total amount of liquid products. Liquid samples were analyzed by a GC-FID (gas chromatograph with flame ionization detector from Shimadzu 2010Plus) for hydrocarbons and oxygenates. Gas bag samples were analyzed using an Agilent GC 7890B gas chromatograph.

The results of the experiments for various feeds are presented in TABLE 2. The balances of the products unaccounted for in TABLE 2 comprise water, inert solids, and minor components not readily recovered for combustion.

A spreadsheet was developed to calculate the energy balance for the catalytic pyrolysis process including the heat up of the feeds and the fluidization gas and the separation and purification of BTX. The assumptions used in the calculation included:

1. 100 kg/hr of plastic is pyrolyzed in the process
2. Heat exchanger efficiency is 80% (Heat recovery from flue gas and reactor effluent is 80%)
3. Air to the regenerator is 20% beyond the stoichiometric amount required to combust the coke (and gas, when needed)
4. Heat loss in the regenerator is 2% of the heat load of the regenerator
5. Catalyst to Plastic Ratio is 15 (1500 kg catalyst in reactor)
6. Carbon load on the regenerator is assumed to be 15 wt %.
7. Catalytic pyrolysis yields of products are linear combinations of those listed in TABLE 2 for feed mixtures weighted by the mass of each constituent of the feed mixture.
8. Combustion heat released in the regenerator is a linear combination of those listed in TABLE 3 for the appropriate mixture of coke and gas products in each Example weighted by the mass of each constituent of the feed mixture.
9. The heats of reaction required for the process are linear combinations of those listed in TABLE 4 weighted by the mass of each constituent of the feed mixture.
10. The heat capacity of the catalyst is 1.2 kJ/kg-T.
11. The heat capacity of the fluidization gas is 1.0 kJ/kg-T.
12. The regenerator is operated at 670° C.
13. The heat capacity of the reactor effluent is 1.48 kJ/kg-T.
14. The catalytic pyrolysis is operated at 525° C.
15. The energy required for heating the feed, heating the air for the regenerator, and losses from the process and regenerator is about 127,000 kJ.

TABLE 2

Products of catalytic pyrolysis of various materials with ZSM-5 catalyst in drop tube experiments. All values are weight percent.

| Feed | BTX | Other C5 + Liquid | Coke and Char | Olefins | Paraffins | H2 | CO | CO2 | Ash | Total |
|---|---|---|---|---|---|---|---|---|---|---|
| Polyethylene (PE) | 52.8 | 3.5 | 0.9 | 18.1 | 16.4 | 2.6 | 0.3 | 0.3 | 0 | 94.8 |
| Polypropylene (PP) | 45.6 | 4.0 | 0.7 | 21.5 | 16.5 | 2.4 | 0 | 0.2 | 0 | 90.8 |
| High Density Polyethylene (HDPE) | 53.05 | 3.47 | 1.05 | 17.25 | 18.53 | 2.7 | 0 | 0.21 | 0 | 96.3 |
| Isoprene | 32.88 | 10.03 | 1.29 | 10.43 | 5.89 | 1.29 | 0 | 0.28 | 0 | 62.1 |
| Tire Sidewall | 14.94 | 3.13 | 21.62 | 8.25 | 2.08 | 0.9 | 0.56 | 0.95 | 7.0 | 59.4 |
| Tire Tread | 13.9 | 2.99 | 20.37 | 7.53 | 2.12 | 0.94 | 0.25 | 0.8 | 7.0 | 55.9 |
| Biomass | 5.96 | 1.34 | 23.69 | 2.95 | 2.66 | 0.58 | 17.42 | 9.4 | 0.01 | 64.0 |
| Cellulose | 4.8 | 1.13 | 18.74 | 2.76 | 2.06 | 0.42 | 13 | 13 | 0 | 55.9 |
| Cotton Clothing | 5.97 | 1.32 | 16.68 | 3.47 | 2.02 | 0.49 | 14.62 | 15.72 | 0 | 60.3 |
| PET | 23.73 | 3.92 | 17.76 | 4.98 | 1.16 | 0.38 | 7.65 | 34.13 | 0 | 93.7 |
| PET Clothing | 23.06 | 4.12 | 16.96 | 2.17 | 1.3 | 0.38 | 7.37 | 31.67 | 0 | 87.0 |
| Cellulose Acetate | 7.85 | 1.45 | 14.99 | 5.44 | 2.62 | 0.41 | 9.58 | 25.31 | 0 | 67.7 |
| Polystyrene (PS) | 38.51 | 36.29 | 4.13 | 5.58 | 1.49 | 0.48 | 0 | 0.33 | 0 | 86.8 |
| Nylon | 10.08 | 6.2 | 10.0 | 16.57 | 1.23 | 1.2 | 3.72 | 4.19 | 0 | 53.2 |

TABLE 3

| Heats of Combustion of Various Materials | |
|---|---|
| Material | Heat of Combustion* kJ/kg |
| Olefins | 50,000 |
| Paraffins | 51,000 |
| Hydrogen | 143,000 |
| Coke and Char | 34,000 |
| CO | 10,104 |
| Natural Gas (NG) | 50,000 |
| Tire | 40,000 |

*NIST database

TABLE 4

| Heat of Reaction of the catalytic pyrolysis for various feeds at the temperature of the reaction, kJ/kg | | | | | |
|---|---|---|---|---|---|
| PE | PP | PET | Biomass | Tire | PS |
| 3,000 | 3,000 | 1,800 | 1,600 | 2,000 | 1,000 |

Examples 1 Through 7

The minimum energy required for a catalytic pyrolysis process includes the energy of reaction, the energy for heating the feeds, the energy lost from the process, and the energy required for the separation and purification of the products. For Example 1, when 42.8 kg of polyethylene are catalytically reacted, the energy required is 128,000 kJ, and 0.38 kg of coke is produced. When 57.2 kg of PET is catalytically pyrolyzed the energy required is 103,000 kJ and 10.16 kg of coke is produced. Including the 127,000 kJ required for heating and energy lost from the process, the total minimum energy required is (128,000+103,000+127,000) kJ=358,000 kJ. The combustion of the coke produced generates the 358,000 kJ needed for the process to be self-sufficient, i.e., it requires no input of energy from external sources such as fossil fuels.

The amount of high coke-forming material needed to be mixed with PE, PP, and PS in order to meet the total minimum energy required for the process was calculated for each of the polymers with PET (Examples 1, 4, and 5), biomass (Examples 2 and 6), or tires as the high coke-forming material (Examples 3, and 7) for PE, PP, and PS, as indicated.

The results in TABLE 5 show that by mixing high coke-forming materials with polymers an overall energy balanced process can be achieved when the coke is combusted to provide the energy for the process. The fraction of high coke-forming material in TABLE 5 is the minimum amount of that material required, which, when the coke is combusted, provides the minimum amount of energy required for the process; higher fractions of high coke-forming material in the mixtures result in an excess of energy available for operation of other processes or export from the plant.

Table 5 presents the calculated amount of high coke-forming material needed for the heat from the coke and char combustion to balance the heat needed for the process to convert various mixtures containing low coke-forming polymers to valuable aromatics, olefins, and other products.

TABLE 5

| | Low coke-forming polymers, mass % | | | High coke-forming materials, mass % | | |
|---|---|---|---|---|---|---|
| | PE | PP | PS | PET | Biomass | Tire |
| Example 1 | 42.8 | — | — | 57.2 | — | — |
| Example 2 | 56.6 | — | — | — | 43.4 | — |
| Example 3 | 50.7 | — | — | — | — | 49.3 |
| Example 4 | — | 42.4 | — | 57.6 | — | — |
| Example 5 | — | — | 77.4 | 22.6 | — | — |
| Example 6 | — | — | 85.7 | — | 14.3 | — |
| Example 7 | — | — | 82.5 | — | — | 17.5 |

Examples 8 Through 14

The calculation of Examples 1 through 7 were repeated wherein the coke and CO and H2 byproducts are combusted to provide the energy required for conversion of the mixtures. The results are presented in TABLE 6.

The results in TABLE 6 show that mixtures can be formulated that include various high coke-forming materials with various polymers as feeds to a catalytic pyrolysis process such that no external source of energy is required, i.e. the energy produced in the combustion of the coke and H2 and CO byproducts at least equals the minimum energy required for the catalytic pyrolysis process. The fraction of high coke-forming material in TABLE 6 is the minimum amount of high coke-forming material required to balance the energy requirements of the process; higher fractions of coke-forming material in the mixtures results in an excess of energy available for operation of other processes or export from the plant.

Table 6 presents the calculated amount of high coke-forming feed material needed when the heat of combustion from the coke and byproduct gases H2 and CO are used to balance the heat needed for the process to convert various low coke-forming polymers to aromatics, olefins, and other valuable products.

TABLE 6

| | Low coke-forming polymers, mass % | | | High coke-forming materials, mass % | | |
|---|---|---|---|---|---|---|
| | PE | PP | PS | PET | Biomass | Tire |
| Example 8 | 95.1 | — | — | 4.9 | — | — |
| Example 9 | 97.2 | — | — | — | 2.8 | — |
| Example 10 | 96.1 | — | — | — | — | 3.9 |
| Example 11 | — | 87.6 | — | 12.4 | — | — |
| Example 12 | — | — | 96.0 | 4.0 | — | — |
| Example 13 | — | — | 97.7 | — | 2.3 | — |
| Example 14 | — | — | 96.8 | — | — | 3.2 |

Examples 15 Through 19

The calculation of the previous Examples was repeated with the proviso that the energy required for the catalytic pyrolysis process was provided by the combustion of the coke produced in the process and a fraction of the gas mixture recovered after removing C5+ products, i.e. gas containing C2-C4 olefins and paraffins, CH4, CO, CO2, and H2. The fraction of gas needed to balance the energy requirement is presented in TABLE 7.

The results in TABLE 7 show that addition of a high coke-forming material to the feed to a catalytic pyrolysis of polymers can balance the energy requirement of the process when the coke and at least a fraction of the gaseous byproducts are combusted to provide the energy for the catalytic pyrolysis process. The fraction of gaseous byproducts presented in TABLE 7 is the minimum amount required to equal the minimum energy required for the catalytic pyrolysis process when the gases are combusted in addition to the coke; higher fractions of gaseous byproduct combustion results in an excess of energy available for operation of other processes or export from the plant.

Table 7 presents the calculated fraction of the byproduct gas mixture that needs to be combusted along with all of the coke formed in the process to provide the energy needed for the process to convert various low coke-forming polymers and mixtures of low and high coke-forming materials to aromatics, olefins, and other valuable products.

TABLE 7

| | PE kg | PP kg | PS kg | PET kg | Bio-mass kg | Tire kg | Byproduct Gas Fraction Combusted |
|---|---|---|---|---|---|---|---|
| Example 15 | 100 | — | — | — | — | — | 18.8% |
| Example 16 | — | 100 | — | — | — | — | 17.9% |
| Example 17 | — | — | 100 | — | — | — | 20.4% |
| Example 18 | 95 | — | — | — | — | 5 | 17.5% |
| Example 19 | 95 | — | — | — | — | 5 | 11.7% |

The results presented in Examples 1 through 19 show that the minimum energy requirements of a process to catalytically pyrolyze plastics to produce useful materials such as BTX and olefins can be met by the energy generated by combustion of the coke, or the coke and some fraction of the byproduct gases, when a coke-forming material is fed along with the polymers. The Examples demonstrate only a small number of the combinations of coke-forming materials and polymers that can be used to produce an energy balanced process; someone skilled in the art can readily apply the principles of this invention to any mixture of feedstocks that are encountered.

Examples 20 Through 22

A computational model was built in Excel to calculate the buildup of contaminants on the catalyst as a function of the fraction of coke-forming material in an otherwise contaminant free polyethylene feed, the level of contaminants in the coke-forming material, and the rate of catalyst replacement. The model calculates the steady state of the contaminants on the catalyst that is reached with continuous operation of a catalyzed pyrolysis process in a fluidized bed.

Example 20

Figure 8:
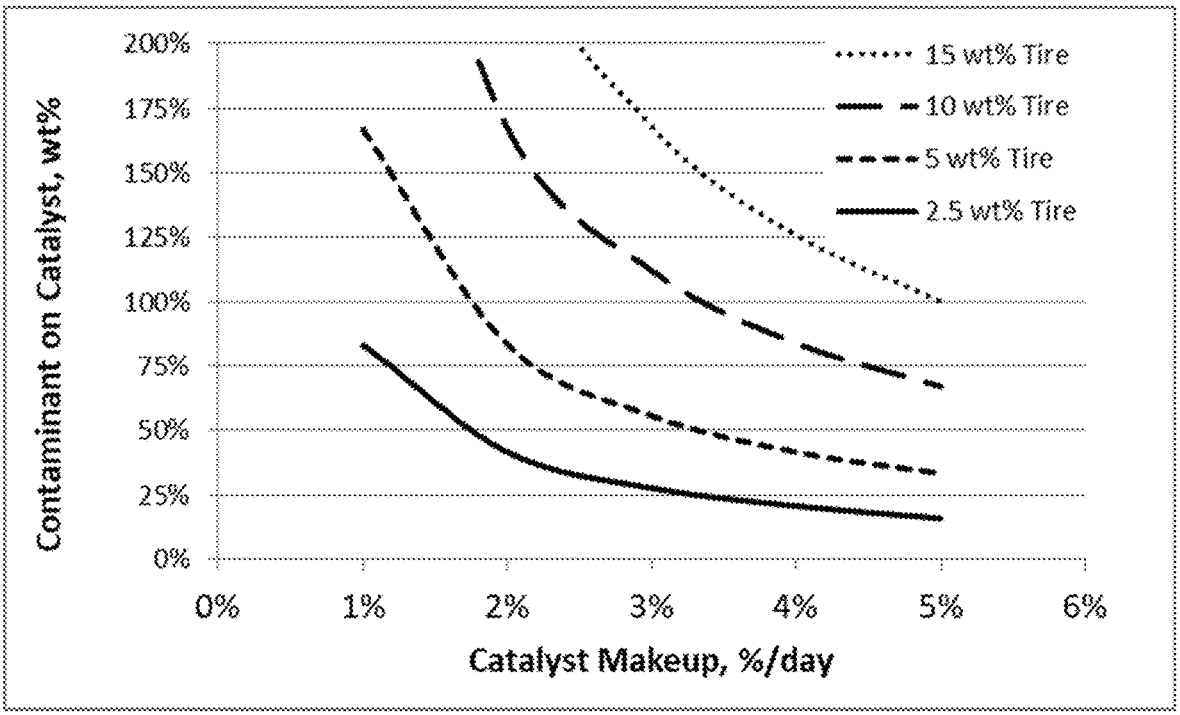
FIG. 8 shows the steady state loading of inert contaminants on the catalyst as a function of catalyst replacement rate when tires containing 7% inert contaminants (e.g. silica) are fed as the coke-forming feed along with polyethylene in a catalytic pyrolysis process.

FIG. 8 shows the calculated steady state loading of inert contaminants on the catalyst as a function of catalyst replacement rate when tires containing 7% inert contaminants (e.g. silica) are fed as the coke-forming feed along with polyethylene in a catalytic pyrolysis process. The fractions of tires included in the feed were 2.5%, 5%, 10%, and 15% by weight. The results presented in FIG. 8 can be used to optimize the process with respect to catalyst cost, catalyst tolerance to contaminants, catalyst makeup rate, and availability and cost of feed materials.

Example 21

Figure 9:
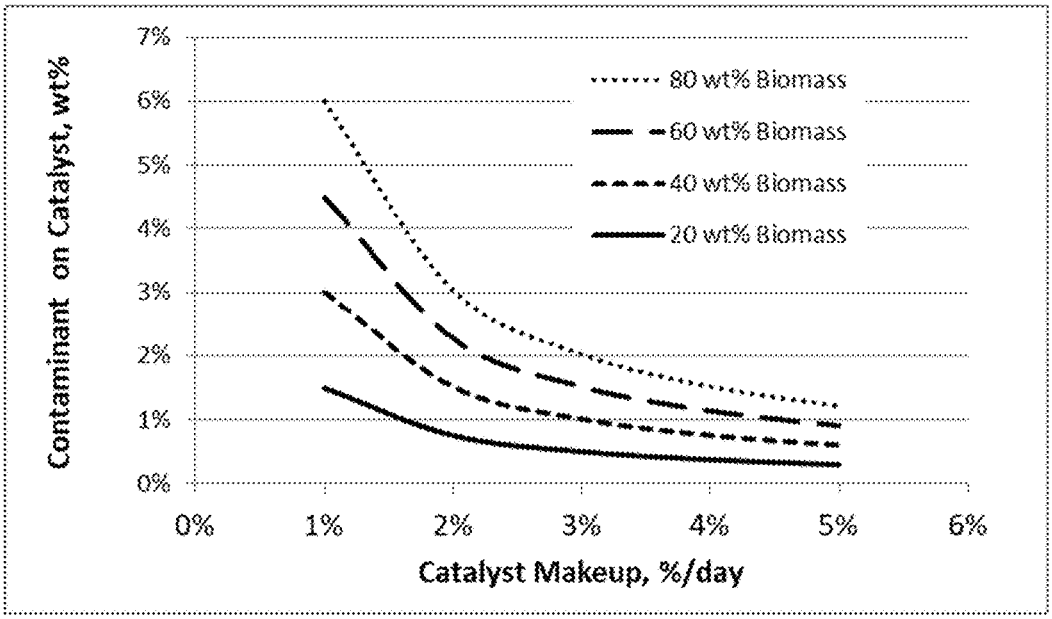
FIG. 9 shows the steady state loading of inert contaminants on the catalyst as a function of catalyst replacement rate when biomass containing 0.4% inert contaminants (e.g. silica) is fed as the coke-forming feed along with polyethylene in a catalytic pyrolysis process.

FIG. 9 shows the calculated steady state loading of inert contaminants on the catalyst as a function of catalyst replacement rate when biomass containing 0.4% inert contaminants (e.g. silica) is fed as the coke-forming feed along with polyethylene in a catalytic pyrolysis process. The mass fractions of biomass included in the feed are 20%, 40%, 60%, and 80% by weight. The results presented in FIG. 9 can be used to optimize the process with respect to catalyst cost, catalyst tolerance to contaminants, catalyst makeup rate, and availability and cost of feed materials.

Example 22

Figure 10:
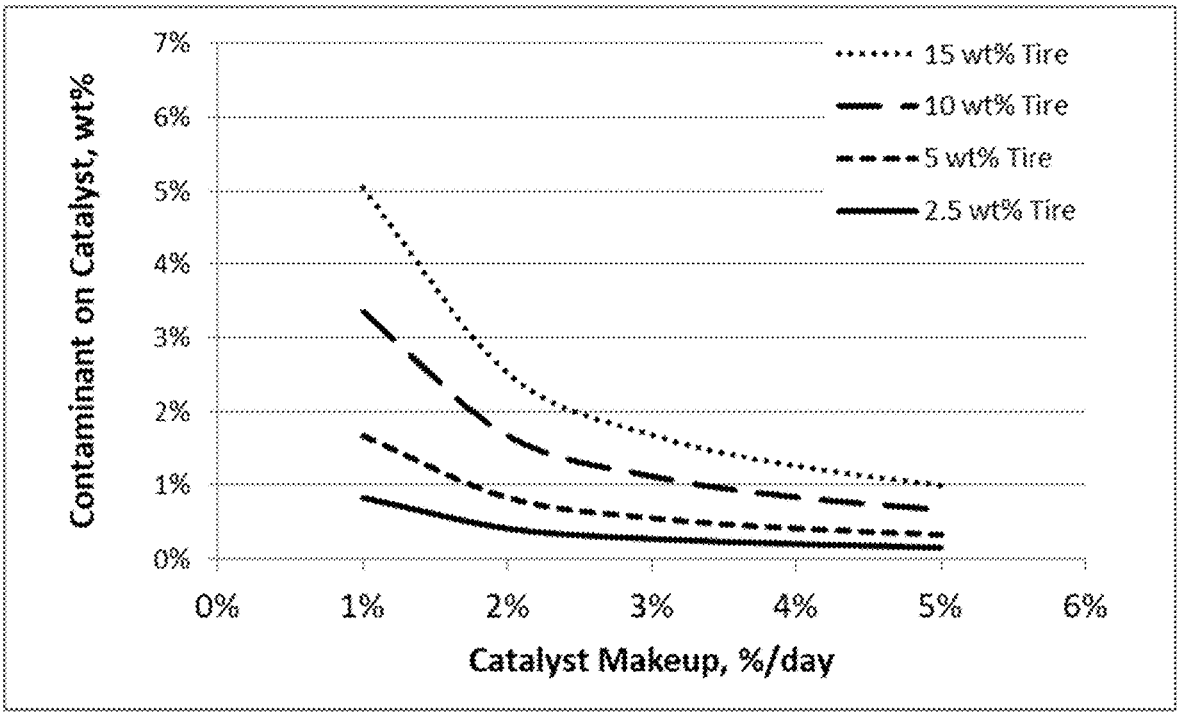
FIG. 10 shows the steady state loading of inert contaminants on the catalyst as a function of catalyst replacement rate when tires containing 7% inert contaminants (e.g. silica) are pre-pyrolyzed in a separate process to remove 99% of the inert contaminants and the vapors are fed along with polyethylene in a catalytic pyrolysis process.

FIG. 10 shows the calculated steady state loading of inert contaminants on the catalyst as a function of catalyst replacement rate when tires containing 7% inert contaminants (e.g. silica) are pre-pyrolyzed in a separate process to remove 99% of the inert contaminants and the vapors are fed along with polyethylene in a catalytic pyrolysis process. The fractions of tires from which the vapors were produced are 2.5%, 5%, 10%, and 15% by weight in the feed mixture with polyethylene. The calculated steady state loading of inert contaminants is much lower than in Example 20 in which untreated tires were co-fed with polyethylene, and is comparable to the loading from co-feed experiments with biomass as the co-feed in Example 21. This demonstrates the advantage in catalyst usage and cost when tires are pre-pyrolyzed in the process. The pre-pyrolysis produces a carbon rich solid derived from the tires that contains most of the inert contaminants and the carbon black that was a component of the tires. This carbon rich solid can be combusted to provide at least part of the energy required for the catalytic pyrolysis process. The vapors from the pre-pyrolysis, when fed to the catalytic pyrolysis, increase the yield of aromatics, olefins, and other valuable components in the catalytic pyrolysis process. The results presented in FIG. 10 can be used to optimize the process with respect to catalyst cost, catalyst tolerance to contaminants, feed pre-treatment costs, contaminant removal effectiveness, process complexity, catalyst makeup rate, and availability and cost of feed materials.

What is claimed:

1. A method of catalytically pyrolyzing a mixed feed of materials, comprising:

providing a first stream comprising a polymer;

adding a high coke-forming material to form a mixed feed of materials;

adding the mixed feed of materials to a fluidized bed reactor;

pyrolyzing the mixed feed in the presence of a solid catalyst in the fluidized bed reactor to produce a fluid product stream and used catalyst with coke, and wherein at least 95% of the carbon in the mixed feed is converted to coke and volatile products;

transferring at least a portion of the used catalyst with coke to a regenerator where the coke is reacted with oxygen to form hot regenerated catalyst and returning at least a portion of the hot regenerated catalyst to the fluidized bed reactor wherein heat from the hot regenerated catalyst provides energy to the step of pyrolyzing; and wherein either (a) heat from combusting the coke provides at least 90% of the energy to the step of pyrolyzing, wherein the first stream has the property such that if a stream consisting of only the first stream would be subjected to the step of pyrolyzing and if all of the used catalyst with coke would be transferred to the regenerator where the coke is combusted with oxygen to form the hot regenerated catalyst and hot combustion gases and returning all of the hot regenerated catalyst to the fluidized bed reactor wherein the heat from the hot regenerated catalyst provides energy to the step of pyrolyzing, then the heat provided by the combustion of the coke, including heat of the catalyst and heat recovered from the combustion gases, provides energy that would be less than the minimum energy required for the catalytic pyrolysis process in which at least 95% of the carbon in the first stream is converted to coke and volatile products; and wherein the addition of the coke-forming materials to the mixed feed results in sufficient coke to provide, upon combustion of the coke, at least the minimum energy required for a catalytic pyrolysis process in which at least 95% of the carbon in the mixed feed is converted to coke and volatile products; or (b) heat from combusting the coke and a portion of the volatile products provides at least 90% of the energy to the step of pyrolyzing, wherein the first stream has the property such that if a stream consisting of only the first stream would be subjected to the step of pyrolyzing and if all of the used catalyst with coke and the portion of the volatile products would be transferred to the regenerator where the coke and the portion of the volatile products is combusted with oxygen to form the hot regenerated catalyst and hot combustion gases and returning all of the hot regenerated catalyst to the fluidized bed reactor wherein the heat from the hot regenerated catalyst provides energy to the step of pyrolyzing, then the heat provided by the combustion of the coke, including heat of the catalyst and heat recovered from the combustion gases, provides energy that would be less than the minimum energy required for the catalytic pyrolysis process in which at least 95% of the carbon in the first stream is converted to coke and volatile products; and wherein the addition of the coke-forming materials to the mixed feed results in sufficient coke and a portion of volatile products to provide, upon combustion of the coke and portion of volatile products, at least the minimum energy required for a catalytic pyrolysis process in which at least 95% of the carbon in the mixed feed is converted to coke and volatile products.

2. The method of claim 1 wherein heat from combusting coke and a portion of the volatile products provides at least 90% of the energy to the step of pyrolyzing and wherein the portion of the volatile products combusted comprises a fraction of the gas mixture recovered after removing C5+ products from the volatile products.

3. The method of claim 1 wherein the mixed feed materials are selected from biomass, polyethylene (PE), polypropylene (PP), polyacetylene, polybutylene, polyolefins, polyethylene terephthalate (PET), polybutyleneterephthalate, copolyesters, polyester, polycarbonate, polyurethanes, polyamides, polystyrene (PS), polyacetal, epoxies, polycyanurates, polyacrylics, polyurea, vinyl esters, polyacrylonitrile, polyvinyl alcohol, polyvinylchloride (PVC), polyvinyl acetate, nylon, copolymers, ethylene-propylene, EPDM, acrylonitrile-butadiene-styrene (ABS), nitrile rubber, natural and synthetic rubber, tires, styrene-butadiene, styrene-acrylonitrile, styrene-isoprene, styrene-maleic anhydride, ethylene-vinylacetate, nylon 12/6/66, filled polymers, polymer composites, plastic alloys, other polymeric materials, and polymers or plastics dissolved in a solvent, whether obtained from polymer or plastic manufacturing processes as waste or discarded materials, post-consumer recycled polymer materials, materials separated from waste streams, municipal solid waste, black liquor, wood waste, or other biologically produced materials, or some combination of these.

4. The method of claim 1 wherein the polymer is selected from among polyethylene, polypropylene, and polystyrene, or mixtures thereof, and the high coke-forming material is selected from among biomass, polyethyleneterephthalate, tires, cellulose, cellulose acetate, cotton clothing, and nylon, or mixtures thereof.

5. The method of claim 1 wherein the reaction is conducted in a fluidized bed, circulating bed, bubbling bed, or riser reactor at an operating temperature in the range from 300° C. to 1000° C., or from 400° C. to 650° C., or from 450° C. to 600° C., or from 500° C. to 575° C.

6. The method of claim 1 wherein the volatile products comprise at least 10 mass % olefins.

7. The method of claim 1 wherein a stream comprising C5+ products is separated from the volatile products.

8. The method of claim 1 wherein the mixed feed comprises from 5 to 98 or 5 to 90, or 20 to 70 or 20 to 90 or 40 to 90 or 40 to 60 mass % of PE, PP, PS or mixtures thereof; and from 2 to 60 or 10 to 60 or 10 to 50 or 15 to 25 or 2 to 15 or 2 to 6 or 2 to 5 or 3 to 4 mass % high coke forming materials, or 20 to 60 or 4 to 15 mass % PET, or 2 to 50 or 10 to 50 or 2 to 3 mass % biomass, or 2 to 55 or 10 to 50 or 40 to 55 or 5 to 20 or 2 to 5 mass % tire polymer, not including mass of contaminants.

9. The method of claim 1 wherein the mixed feed comprises from 5 to 98 or 5 to 90, or 20 to 70 or 20 to 90 or 40 to 90 or 40 to 60 mass % of PE, PP, PS or mixtures thereof; and the balance of the mixed feed comprises at least 95 mass % high coke-forming materials.

10. The method of claim 1 wherein heat from combusting coke and a portion of the volatile products provides at least 90% of the energy to the step of pyrolyzing and wherein the portion of the volatile products combusted comprises a CO and H2 enriched stream separated from the volatile products.

11. The method of claim 1 wherein heat from combusting coke provides at least 90% of the energy required for the step of pyrolyzing.

12. The method of claim 1 wherein a stream enriched in ethylene or propylene, or both is separated from the volatile products.

13. The method of claim 1 wherein a stream enriched in benzene, toluene, xylenes, or some combination of these is separated from the volatile products.

14. The method of claim 1 wherein the mass yield of BTX is at least 10%, or at least 20%, or at least 25%, or at least 30%, or at least 35%, or at least 40%, or from 10% to 70%, or from 20% to 65%, or from 25% to 60%, based on the mass in the polymer feed.

15. The method of claim 1 wherein the mixed feed comprises from 5 to 98 or 5 to 90, or 20 to 70 or 20 to 90 or 40 to 90 or 40 to 60 mass % of PE, PP, PS or mixtures thereof; and the balance of the mixed feed comprises at least 95 mass % high coke-forming materials.

* * * * *